US007491879B2

(12) United States Patent
Hikino et al.

(10) Patent No.: US 7,491,879 B2
(45) Date of Patent: Feb. 17, 2009

(54) STORAGE MEDIUM HAVING MUSIC PLAYING PROGRAM STORED THEREIN AND MUSIC PLAYING APPARATUS THEREFOR

(75) Inventors: Mitsuhiro Hikino, Kyoto (JP); Junya Osada, Kyoto (JP)

(73) Assignee: Nintendo Co. Ltd., Kyoto (JP)

( * ) Notice: Subject to any disclaimer, the term of this patent is extended or adjusted under 35 U.S.C. 154(b) by 43 days.

(21) Appl. No.: 11/542,243

(22) Filed: Oct. 4, 2006

(65) Prior Publication Data

US 2007/0256546 A1 Nov. 8, 2007

(30) Foreign Application Priority Data

Apr. 25, 2006 (JP) ..... 2006-120926

(51) Int. Cl.
*G10H 1/18* (2006.01)

(52) U.S. Cl. ..... 84/615; 84/609; 84/649; 84/653

(58) Field of Classification Search ..... 84/609, 84/615, 649, 653
See application file for complete search history.

(56) References Cited

U.S. PATENT DOCUMENTS

| | | | | |
|---|---|---|---|---|
| 4,839,838 | A | 6/1989 | LaBiche et al. | |
| 5,005,459 | A * | 4/1991 | Adachi et al. | 84/453 |
| 5,059,958 | A | 10/1991 | Jacobs et al. | |
| 5,128,671 | A | 7/1992 | Thomas, Jr. | |
| 5,440,326 | A | 8/1995 | Quinn | |
| 5,702,323 | A | 12/1997 | Poulton | |
| 5,898,421 | A | 4/1999 | Quinn | |
| 5,913,727 | A | 6/1999 | Ahdoot | |
| 5,920,024 | A * | 7/1999 | Moore | 84/609 |
| 6,066,075 | A | 5/2000 | Poulton | |
| 6,072,467 | A | 6/2000 | Walker | |
| 6,315,673 | B1 | 11/2001 | Kopera et al. | |
| 6,375,572 | B1 | 4/2002 | Masuyama et al. | |
| 6,545,661 | B1 | 4/2003 | Goschy et al. | |
| 6,908,386 | B2 | 6/2005 | Suzuki et al. | |
| 6,908,388 | B2 | 6/2005 | Shimizu et al. | |

(Continued)

FOREIGN PATENT DOCUMENTS

| | | |
|---|---|---|
| EP | 0 835 676 | 4/1998 |

(Continued)

OTHER PUBLICATIONS

Electronic Entertainment Expo (E3) advertisement for G-Force Tilt "TILTPAK Rumble & Motion Sensing Pak for Nintendo 64".

(Continued)

*Primary Examiner*—Jeffrey Donels
*Assistant Examiner*—Kawing Chan
(74) *Attorney, Agent, or Firm*—Nixon & Vanderhye P.C.

(57) ABSTRACT

Acceleration data outputted from an acceleration sensor provided in an input device is acquired and a magnitude of an acceleration is calculated. Next, based on the calculated magnitude of the acceleration, at least one piece of track data representing a target music to play is selected from music piece data including a plurality of pieces of track data stored in memory means. Then, based on the selected track data, data for controlling a sound generation device is outputted.

9 Claims, 20 Drawing Sheets

U.S. PATENT DOCUMENTS

| | | | | |
|---|---|---|---|---|
| 7,094,147 | B2 | 8/2006 | Nakata et al. | |
| 7,169,998 | B2 | 1/2007 | Kondo et al. | |
| 2004/0000225 | A1 * | 1/2004 | Nishitani et al. | 84/610 |
| 2006/0060068 | A1 * | 3/2006 | Hwang et al. | 84/615 |
| 2007/0113726 | A1 * | 5/2007 | Oliver et al. | 84/615 |

FOREIGN PATENT DOCUMENTS

| | | |
|---|---|---|
| JP | 62-143124 | 6/1987 |
| JP | 6-161440 | 6/1994 |
| JP | 2000-308756 | 11/2000 |
| JP | 2001-195059 | 7/2001 |

OTHER PUBLICATIONS

Electronic Entertainment Expo (E3) advertisement for G-Force Tilt "TILTFORCE$^2$ Motion-Sensing & Vibration Controller for Playstation Game Console".

News Article "New Game Controllers Using Analog Devices' G-Force Tilt to be Featured at E3", Norwood, MA (May 10, 1999).

U.S. Appl. No. 11/406,276, filed Apr. 19, 2006.

* cited by examiner

FIG. 16

Sd1

| TRACK NUMBER | NAME OF MUSICAL INSTRUMENT | TRACK MUSIC DATA START | END |
|---|---|---|---|
| 1 | Fl(FLUTE) | | |
| 2 | Vn(VIOLIN) | | |
| 3 | P(PIANO) | | |
| 4 | Cl(CLARINET) | ⋮ | ⋮ |
| 5 | G(GUITAR) | ⋮ | ⋮ |
| 6 | Ob(OBOE) | ⋮ | ⋮ |
| 7 | Hrn(HORN) | ⋮ | ⋮ |
| 8 | Vc(CELLO) | ⋮ | ⋮ |
| 9 | Va(VIOLA) | ⋮ | ⋮ |
| 10 | Trb(TROMBONE) | ⋮ | ⋮ |
| 11 | Timp(TIMPANI) | ⋮ | ⋮ |
| 12 | Snare(SNARE) | ⋮ | ⋮ |
| ⋮ | ⋮ | ⋮ | ⋮ |
| 16 | ⋮ | ⋮ | ⋮ |

FIG. 18

De

| RESULTANT VECTOR PEAK VALUE | TO-BE-SELECTED TRACK NUMBER |
|---|---|
| $Vp < V1$ | 1,3,5 |
| $V1 \leqq Vp < V2$ | 1,2,3,5,10,12 |
| $V2 \leqq Vp < V3$ | 1,2,3,5,7,8,10,12,15,16 |
| $V3 \leqq Vp$ | 1～16 |

FIG. 19

Df

| DIFFERENCE RESULTANT VECTOR PEAK VALUE | TO-BE-SELECTED SEQUENCE NUMBER |
|---|---|
| $Dp < D1$ | Sd1 |
| $D1 \leqq Dp$ | Sd2 |

STORAGE MEDIUM HAVING MUSIC PLAYING PROGRAM STORED THEREIN AND MUSIC PLAYING APPARATUS THEREFOR

CROSS REFERENCE OF RELATED APPLICATION

The disclosure of Japanese Patent Application No. 2006-120926, filed Apr. 25, 2006, is incorporated herein by reference.

BACKGROUND

1. Field of the Present Technology

Example embodiment(s) of present technology described herein relates to a storage medium having a music playing program stored therein and a music playing apparatus therefor. More specifically, the present example embodiment(s) relates to a storage medium having a music playing program for playing music in accordance with movement of an input device having an acceleration sensor, and a music playing apparatus therefor.

2. Description of the Background Art

Conventionally, it is known that a game is performed with music conducting and a sense of entertainment in karaoke is thereby enhanced. For example, Japanese Laid-Open Patent Publication No. 6-161440 (hereinafter, referred to as "patent document 1") discloses an apparatus in which timing to read data for pitch and intensity in music score data is caused to follow an output from a baton having an acceleration sensor. In addition, Japanese Laid-Open Patent Publication No. 2001-195059 (hereinafter, referred to as "patent document 2"), for example, discloses an apparatus in which sound volume for MIDI (Musical Instrument Digital Interface) data is changed in accordance with an output from an acceleration sensor incorporated in a motion detector and state detector held by a user or attachable to the user, and a playback tempo is caused to follow thereto. In the sound playback apparatus disclosed in the above-described patent document 2, buttons are provided for the user to designate a degree to which a playback tempo follows the output of the acceleration sensor, in an effort not to cause a great difference between a tempo based on a user conducting and an original tempo for a played piece of music.

However, with the conventional technique, a sense of entertainment which can be provided by the apparatuses or the like disclosed in the above-described patent documents 1 and 2 is limited to controlling a tempo in playing a music piece or changing a sound volume of played music, through a sharp/gentle conducting performed by the user. Accordingly, it is impossible with the conventional technique to add an amusing element for the user to enjoy an operation of conducting.

SUMMARY

Therefore, an aspect of the present example embodiment (s) is to provide a storage medium having stored therein a music playing program for playing music with a variety of changes in performance generated in accordance with an operation of an input device, and a music playing apparatus therefor.

The present example embodiment(s) has the following features to attain the aspect mentioned above. Note that reference numerals, step numbers, or the like in parentheses show a corresponding relationship with the preferred embodiments to help understand the present technology, and are not in any way limiting the scope of the present invention.

A first aspect of the present example embodiment(s) is directed to a storage medium having stored therein a music playing program to be executed in a computer (30) of an apparatus (3) operated in accordance with an acceleration detected by an input device (7) including an acceleration sensor (701) for detecting the acceleration in at least one axial direction. The music playing program causes the computer to execute: an acceleration data acquisition step (S54); an acceleration calculation step (S55, S58); a track data selection step (S63, S66, S70); and a music performance step (S68). In the acceleration data acquisition step, acceleration data (Da) outputted from the acceleration sensor is acquired. In the acceleration calculation step, a magnitude (V, D) of the acceleration is calculated by using the acquired acceleration data. In the track data selection step, at least one piece of track data representing a target music to play is selected from music piece data (Dd) including a plurality of pieces of track data (Td, FIGS. 16, 17) stored in memory means (33), based on the calculated magnitude of the acceleration. In the music performance step, data for controlling a sound generated from a sound generation device (2*a*) is outputted based on the track data selected in the track data selection step.

In a second aspect based on the first aspect, the computer is caused to further execute an acceleration peak value detection step (S61). In the acceleration peak value detection step, a peak value (Vp) of the magnitude of the acceleration is detected by using a history (Db) of the magnitude (V) of the acceleration calculated in the acceleration calculation step. In the track data selection step, the track data representing the target music to play is selected based on the peak value, of the magnitude of the acceleration, detected in the acceleration peak value detection step (S63).

In a third aspect based on the first aspect, the acceleration calculation step includes a difference calculation step (S57, S58). In the difference calculation step, a difference (D) between an acceleration (Xa0, Ya0, Za0) calculated by using the acceleration data previously acquired and an acceleration (Xa, Ya, Za) calculated by using the acceleration data currently acquired is calculated. In the track data selection step, the track data representing the target music to play is selected (S66, S70) based on the difference of the acceleration calculated in the difference calculation step.

In a fourth aspect based on the third aspect, the computer is caused to further execute an acceleration difference peak value detection step (S64). In the acceleration difference peak value detection step, a peak value (Dp) of the difference of the acceleration is detected by using a history (Dc) of the difference of the acceleration calculated in the difference calculation step. In the track data selection step, the track data representing the target music to play is selected based on the peak value, of the difference of the acceleration, detected in the acceleration difference peak value detection step.

A fifth aspect based on the first aspect, the music piece data includes a plurality of track data groups (Sd) each having different track data. In the acceleration calculation step, the magnitude (V) of the acceleration calculated from the acceleration data currently acquired, and the difference (D) between the acceleration calculated by using the acceleration data previously acquired and the acceleration calculated by using the acceleration data currently acquired are calculated. The music playing program causes the computer to further execute an acceleration peak value detection step and an acceleration difference peak value detection step. In the acceleration peak value detection step, a peak value of the magnitude of the acceleration is detected by using a history of the magnitude of the acceleration calculated in the acceleration calculation step. In the acceleration difference peak value detection step, a peak value of the difference of the acceleration is detected by using a history of the difference of the acceleration calculated in the acceleration calculation step. In the track data selection step, a track data group representing a target music to play is selected based on the peak value of the difference of the acceleration detected in the acceleration difference peak value detection step, and, based on the peak value of the magnitude of the acceleration detected in the acceleration peak value detection step, the track data representing the target music to play is selected from the track data group representing the target music to play.

In a sixth aspect based on the first aspect, the acceleration sensor detects the acceleration in each of a plurality of axial directions (X-, Y-, Z-axis directions) perpendicular to each other with respect to the input device. In the acceleration calculation step, a magnitude of a resultant vector for which acceleration vectors in the plurality of axial directions are respectively combined is calculated by using the acquired acceleration data.

In a seventh aspect based on the third aspect, the acceleration sensor detects the acceleration in each of a plurality of axial directions perpendicular to each other with respect to the input device. In the difference calculation step, the difference between the acceleration calculated by using the acceleration data previously acquired and the acceleration calculated by using the acceleration data currently acquired is calculated for each of the plurality of axial directions, and a magnitude of a difference resultant vector for which difference vectors in the plurality of axial directions are respectively combined is calculated as the difference of the acceleration.

In an eighth aspect based on the first aspect, each of the plurality of pieces of track data is allocated a different musical instrument. The computer is caused to further execute a display processing step. In the display processing step, the musical instrument allocated to each of the plurality of pieces of track data is arranged in a virtual game world, and an action representing only the musical instrument allocated to the track data selected in the track data selection step being played is displayed on a display device (2) (FIGS. 8 and 9).

In a ninth aspect based on the first aspect, each of the plurality of pieces of track data is allocated music data of a different musical instrument.

In a tenth aspect based on the fifth aspect, music data allocated to the track data group and music data allocated to another track data group are different in at least one of a style of playing music, a number of beats, and a tonality.

In an eleventh aspect based on the first aspect, the apparatus includes a sound source (34, 35) for generating the sound from the sound generation device. Each of the plurality of pieces of track data included in the music piece data includes control data of the sound source. In the music performance step, the control data written in the track data selected in the track data selection step is outputted for controlling the sound source.

A twelfth aspect is directed to a music playing apparatus for being operated in accordance with an acceleration detected by an input device including an acceleration sensor for detecting the acceleration in at least one axial direction. The music playing apparatus comprises: acceleration data acquisition means; acceleration calculation means; track data selection means; and music performance means. The acceleration data acquisition means acquires acceleration data outputted from the acceleration sensor. The acceleration calculation means calculates a magnitude of the acceleration by using the acquired acceleration data. The track data selection means selects at least one piece of track data representing a target music to play from music piece data including a plurality of pieces of track data stored in memory means, based on the calculated magnitude of the acceleration. The music performance means outputs data for controlling a sound generated from a sound generation device, based on the track data selected by the track data selection means.

According to the first aspect, a track to play is changed depending on a magnitude of an acceleration detected by an acceleration sensor, whereby a variety of changes in music performance can be generated according to movement of an input device.

According to the second aspect, a track to play is changed depending on a peak value of a magnitude of an acceleration, whereby changes in music performance can be generated according to a magnitude or a speed of movement of an input device.

According to the third aspect, a track to play is changed depending on a difference in a magnitude of an acceleration, whereby changes in music performance can be generated according to gentleness or the like of movement of an input device.

According to the fourth aspect, a track to play is changed depending on a peak value of a difference of a magnitude of an acceleration, whereby changes in music performance can be generated according to the presence or absence of sharpness when an input device is moved in time with beats or the like.

According to the fifth aspect, a track group to play is changed depending on a peak value of a difference of a magnitude of an acceleration, and a track to be selected from the track group is changed depending on a peak value of the magnitude of the acceleration, whereby a further variety of changes in music performance can be generated.

According to the sixth and seventh aspects, because an acceleration sensor for detecting an acceleration in each of a plurality of axial directions perpendicular to each other is used, changes in music performance can be generated according to movement of an input device, irrespective of a direction of the input device held by a user.

According to the eighth aspect, a display device can display a musical instrument to be played being changed.

According to the ninth aspect, a type of a musical instrument to be played is changed by changing track data to be selected, whereby music performance of a piece of music can be changed according to movement of an input device.

According to the tenth aspect, a style of playing music, the number of beats, a tonality, and the like are changed by changing a track data group to be selected, whereby an articulation for a played piece of music can be changed according to movement of an input device.

According to the eleventh aspect, the present example embodiment(s) can be easily realized by using MIDI data.

According to a music playing apparatus of the present example embodiment(s), effects similar to those obtained with a storage medium having stored therein the above-described music playing program can be obtained.

These and other features, aspects and advantages of the present example embodiment(s) will become more apparent from the following detailed description of the present example embodiment(s) when taken in conjunction with the accompanying drawings.

BRIEF DESCRIPTION OF THE DRAWINGS

FIG. 16 is a diagram showing an example of sequence data;

FIG. 18 is a diagram showing an example of a track selection table;

FIG. 19 is a diagram showing an example of a sequence selection table;

DESCRIPTION OF THE PREFERRED EMBODIMENTS

Figure 1:
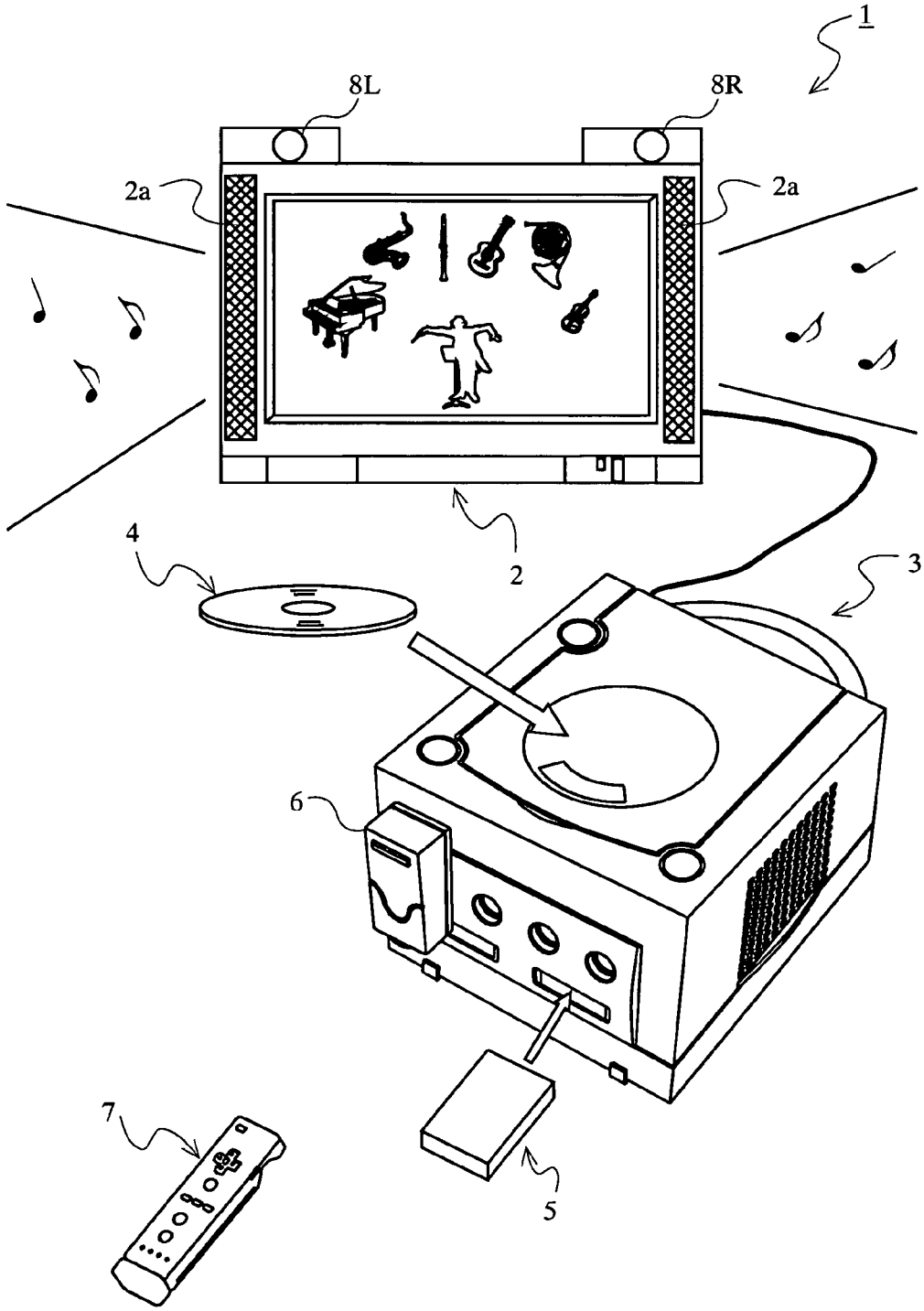
FIG. 1 is an external view for illustrating a game system 1 according to a present example embodiment.

With reference to FIG. 1, a music playing apparatus according to a present example embodiment will be described. Hereinafter, in order to make a description specific, a game system 1 using the music playing apparatus will be described as an example. FIG. 1 is an external view illustrating the game system 1. In the following description, the game system 1 is described as having a stationary type game apparatus corresponding to a music playing apparatus of the present embodiment, as an example.

As shown in FIG. 1, the game system 1 includes a stationary type game apparatus (hereinafter, referred to simply as a "game apparatus") 3, which is connected to a display (hereinafter, referred to as a "monitor") 2 such as a home-use TV receiver including speakers 2*a* via a connection code, and a controller 7 for giving operation data to the game apparatus 3. The game apparatus 3 is connected to a receiving unit 6 via a connection terminal. The receiving unit 6 receives operation data which is wirelessly transmitted from the controller 7. The controller 7 and the game apparatus 3 are connected to each other by wireless communication. On the game apparatus 3, an optical disk 4 as an example of an exchangeable information storage medium is detachably mounted. The game apparatus 3 has, on a top main surface thereof, a power ON/OFF switch, a game processing reset switch, and an OPEN switch for opening a top lid of the game apparatus 3. When a player presses the OPEN switch, the lid is opened, so that the optical disk 4 is mounted or dismounted.

On the game apparatus 3, an external memory card 5 is detachably mounted when necessary. The external memory card 5 has a backup memory or the like mounted thereon for fixedly storing saved data or the like. The game apparatus 3 executes a game program or the like stored on the optical disk 4 and displays the result on the monitor 2 as a game image.

The game apparatus 3 can also reproduce a state of a game played in the past using saved data stored on the external memory card 5 and display the game image on the monitor 2. The player playing with the game apparatus 3 can enjoy the game by operating the controller 7 while watching the game image displayed on the display screen of the monitor 2.

The controller 7 wirelessly transmits transmission data from a communication section 75 (described later) included therein to the game apparatus 3 connected to the receiving unit 6, using the technology of, e.g., Bluetooth®. The controller 7 is an operation means for operating a player object appearing in a game space displayed mainly on the monitor 2. The controller 7 includes an operation section having a plurality of operation buttons, keys, a stick, and the like. As described later in detail, the controller 7 also includes an imaging information calculation section 74 for taking an image viewed from the controller 7. Also, as an example of a target to be imaged by the imaging information calculation section 74, two LED modules (hereinafter, referred to as "markers") 8L and 8R are provided in the vicinity of a display screen of the monitor 2. The markers 8L and 8R each outputs infrared light forward from the monitor 2. In the present embodiment, imaging information obtained by the imaging information calculation section 74 is not used, and therefore, the markers 8L and 8R are not necessarily provided.

Figure 2:
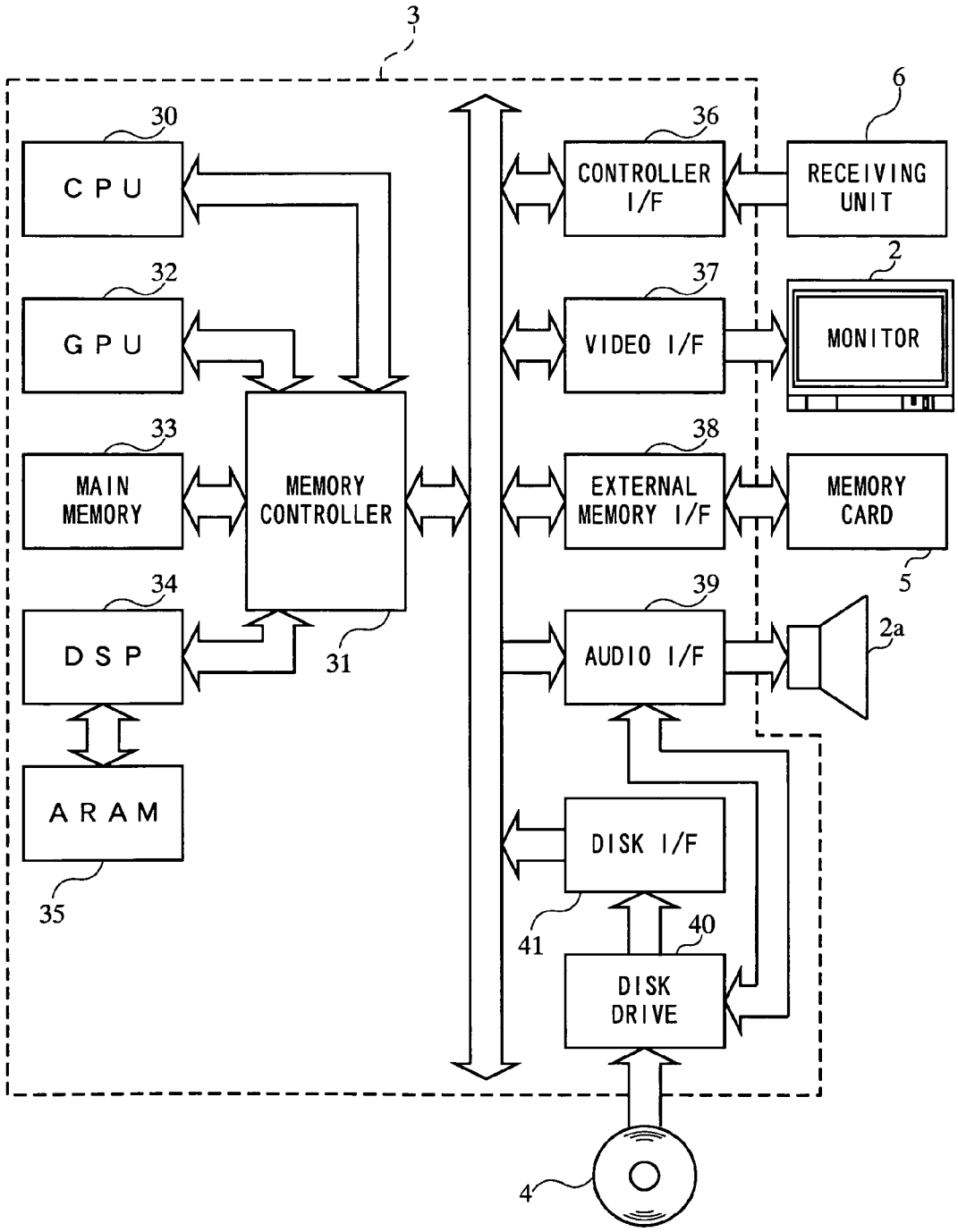
FIG. 2 is a functional block diagram of a game apparatus 3 shown in FIG. 1.

Next, with reference to FIG. 2, a structure of the game apparatus 3 will be described. FIG. 2 is a functional block diagram of the game apparatus 3.

As shown in FIG. 2, the game apparatus 3 includes, for example, a RISC CPU (central processing unit) 30 for executing various type of programs. The CPU 30 executes a start program stored in a boot ROM (not shown) to, for example, initialize memories including a main memory 33, and then executes a game program stored on the optical disk 4 to perform game processing or the like in accordance with the game program. A game program stored in the optical disk 4 includes a music playing program of the present example embodiment(s), and, in the game process, the CPU 30 performs a music performance process for playing music in accordance with movement of the controller 7. The CPU 30 is connected to a GPU (Graphics Processing Unit) 32, the main memory 33, a DSP (Digital Signal Processor) 34, and an ARAM (Audio RAM) 35 via a memory controller 31. The memory controller 31 is connected to a controller I/F (interface) 36, a video I/F 37, an external memory I/F 38, an audio I/F 39, and a disk I/F 41 via a predetermined bus. The controller I/F 36, the video I/F 37, the external memory I/F 38, the audio I/F 39 and the disk I/F 41 are respectively connected to the receiving unit 6, the monitor 2, the external memory card 5, the speakers 2*a*, and a disk drive 40.

The GPU 32 performs image processing based on an instruction from the CPU 30. The GPU 32 includes for example, a semiconductor chip for performing calculation processing necessary for displaying 3D graphics. The GPU 32 performs the image processing using a memory dedicated for image processing (not shown) and a part of the memory area of the main memory 33. The GPU 32 generates game image data and a movie to be displayed on the display screen of the monitor 2 using such memories, and outputs the generated data or movie to the monitor 2 via the memory controller 31 and the video I/F 37 as necessary.

The main memory 33 is a memory area used by the CPU 30, and stores a game program or the like necessary for processing performed by the CPU 30 as necessary. For example, the main memory 33 stores a game program read from the optical disk 4 by the CPU 30, various types of data or the like. The game program, the various types of data or the like stored in the main memory 33 are executed by the CPU 30.

The DSP 34 processes sound data (e.g., MIDI (Musical Instrument Digital Interface data) or the like processed by the CPU 30 during the execution of the game program. The DSP 34 is connected to the ARAM 35 for storing the sound data or the like. The ARAM 35 and the DSP 34 function as a MIDI source when music is played based on the MIDI data. The ARAM 35 is used when the DSP 34 performs predetermined processing (for example, storage of the game program or sound data already read). The DSP 34 reads the sound data stored in the ARAM 35 and outputs the read sound data to the speakers 2*a* included in the monitor 2 via the memory controller 31 and the audio I/F 39.

The memory controller 31 comprehensively controls data transfer, and is connected to the various I/Fs described above. The controller I/F 36 includes, for example, four controller I/Fs 36*a* to 36*d*, and communicably connects the game apparatus 3 to an external device which is engageable via connectors of the controller I/Fs. For example, the receiving unit 6 is engaged with such a connector and is connected to the game apparatus 3 via the controller I/F 36. As described above, the receiving unit 6 receives the transmission data from the controller 7 and outputs the transmission data to the CPU 30 via the controller I/F 36. The video I/F 37 is connected to the monitor 2. The external memory I/F 38 is connected to the external memory card 5 and is accessible to a backup memory or the like provided in the external memory card 5. The audio I/F 39 is connected to the speakers 2*a* built in the monitor 2, and is connected such that the sound data read by the DSP 34 from the ARAM 35 or sound data directly outputted from the disk drive 40 is outputted from the speakers 2*a*. The disk I/F 41 is connected to the disk drive 40. The disk drive 40 reads data stored at a predetermined reading position of the optical disk 4 and outputs the data to a bus of the game apparatus 3 or the audio I/F 39.

Figure 3:
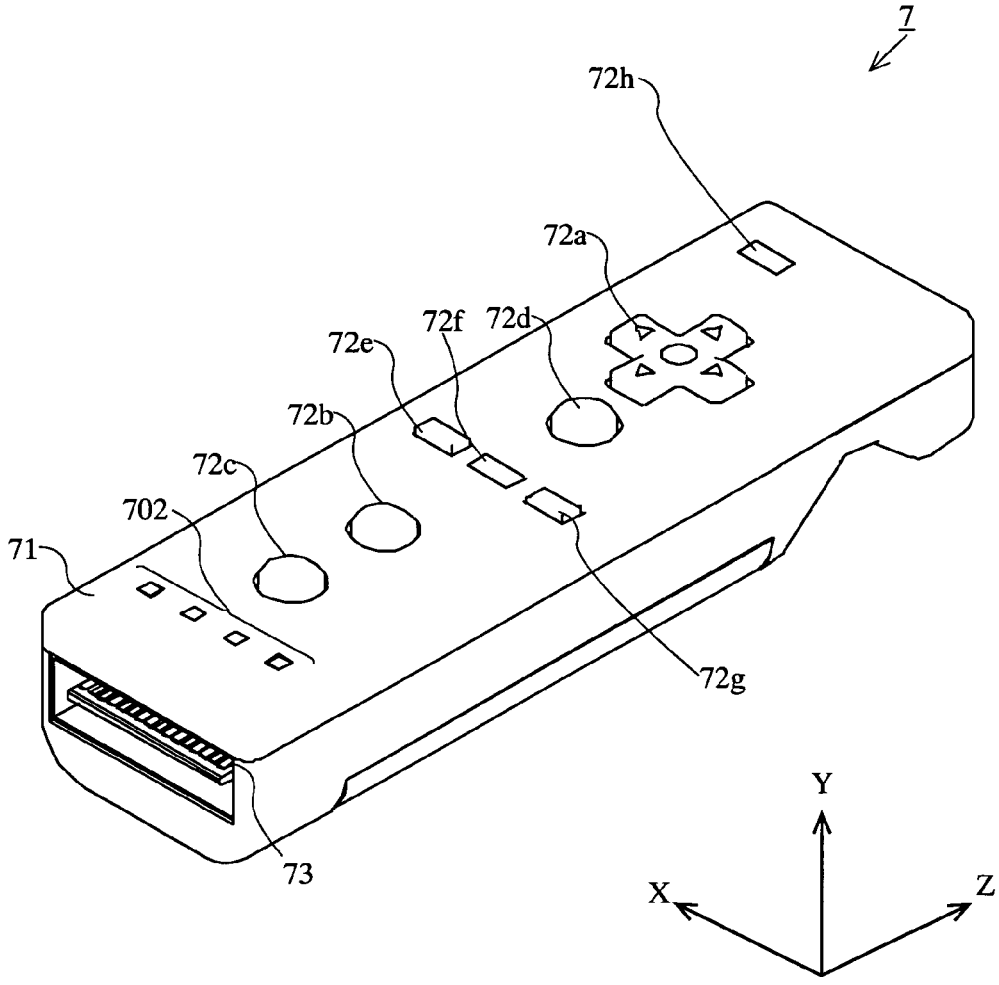
FIG. 3 is a schematic diagrammatic perspective view of the controller 7 shown in FIG. 1 seen from the top rear side thereof.
Figure 4:
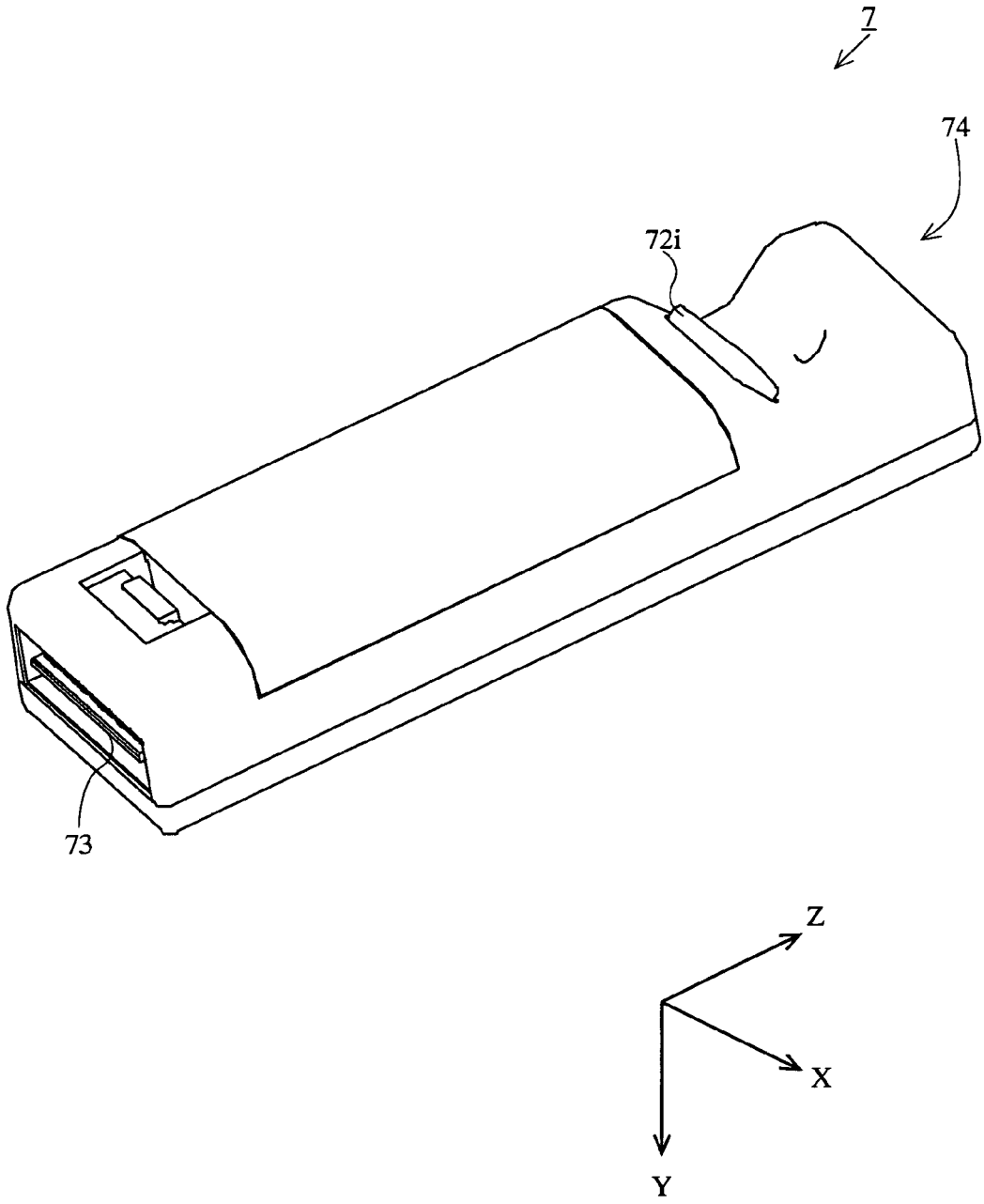
FIG. 4 is a schematic diagrammatic perspective view of the controller 7 shown in FIG. 3 seen from the bottom rear side thereof.

With reference to FIGS. 3 and 4, the controller 7 as an example of an input device of the present example embodiment(s) will be described. FIG. 3 is a schematic diagrammatic perspective view of the controller 7 seen from the top rear side thereof. FIG. 4 is a schematic diagrammatic perspective view of the controller 7 seen from the bottom rear side thereof.

As shown in FIGS. 3 and 4, the controller 7 includes a housing 71 formed by plastic molding or the like, and the housing 71 includes a plurality of operation sections 72. The housing 71 has a generally parallelepiped shape extending in a longitudinal or front-rear direction. The overall size of the housing 71 is small enough to be held by one hand of an adult or even a child.

At the center of a front part of a top surface of the housing 71, a cross key 72*a* is provided. The cross key 72*a* is a cross-shaped four-direction push switch. The cross key 72*a* includes operation portions corresponding to the four directions represented by arrows (front, rear, right and left), which are respectively located on cross-shaped projecting portions arranged at an interval of ninety degrees. The player selects one of the front, rear, right and left directions by pressing one of the operation portions of the cross key 72*a*. Through an operation on the cross key 72*a*, the player can, for example, instruct a direction in which a player character or the like appearing in a virtual game world is to move or a direction in which the cursor is to move.

The cross key 72*a* is an operation section for outputting an operation signal in accordance with the above-described direction input operation performed by the player, but such an operation section may be provided in another form. For example, the cross key 72*a* may be replaced with a composite switch including a push switch including a ring-shaped four-direction operation section and a center switch provided at the center thereof. Alternatively, the cross key 72*a* may be replaced with an operation section which includes an inclinable stick projecting from the top surface of the housing 71 and outputs an operation signal in accordance with the inclining direction of the stick. Still alternatively, the cross key 72*a* may be replaced with an operation section which includes a disc-shaped member horizontally slidable and outputs an operation signal in accordance with the sliding direction of the disk-shaped member. Still alternatively, the cross key 72*a* may be replaced with a touch pad. Still alternatively, the cross key 72*a* may be replaced with an operation section which includes switches representing at least four directions (front, rear, right and left) and outputs an operation signal in accordance with the switch pressed by the player.

Rearward to the cross key 72*a* on the top surface of the housing 71, a plurality of operation buttons 72*b* through 72*g* are provided. The operation buttons 72*b* through 72*g* are each an operation section for outputting a respective operation signal assigned the operation buttons 72*b* through 72*g* when the player presses a head thereof. For example, the operation buttons 72*b* through 72*d* are assigned functions of an X button, a Y button and an A button. The operation buttons 72*e* through 72*g* are assigned functions of a select switch, a menu switch and a start switch, for example. The operation buttons 72*b* through 72*g* are assigned various functions in accordance with the game program executed by the game apparatus 3, but this will not be described in detail because the functions are not directly relevant to the present example embodiment(s). In an exemplary arrangement shown in FIG. 3, the operation buttons 72*b* through 72*d* are arranged in a line at the center in the front-rear direction on the top surface of the housing 71. The operation buttons 72*e* through 72*g* are arranged in a line in the left-right direction on the top surface of the housing 71 between the operation buttons 72*b* and 72*d*. The operation button 72*f* has a top surface thereof buried in the top surface of the housing 71, so as not to be inadvertently pressed by the player.

Forward to the cross key 72*a* on the top surface of the housing 71, an operation button 72*h* is provided. The operation button 72*h* is a power switch for remote-controlling the power of the game apparatus 3 to be on or off. The operation button 72*h* also has a top surface thereof buried in the top surface of the housing 71, so as not to be inadvertently pressed by the player.

Rearward to the operation button 72*c* on the top surface of the housing 71, a plurality of LEDs 702 are provided. The controller 7 is assigned a controller type (number) so as to be distinguishable from other controllers 7. For example, the LEDs 702 are used for informing the controller type which is currently set for the controller 7 to the player. Specifically, when the controller 7 transmits the transmission data to the receiving unit 6, one of the plurality of LEDs 702 corresponding to the controller type is lit up.

On a bottom surface of the housing 71, a recessed portion is formed. The recessed portion on the bottom surface of the housing 71 is formed at a position at which an index finger or middle finger of the player is located when the player holds the controller 7. On a rear slope surface of the recessed portion, an operation button 72*i* is provided. The operation button 72*i* is an operation section acting as, for example, a B button. The operation button 72*i* is used, for example, as a trigger switch in a shooting game or for attracting attention of a player object to a predetermined object.

On a front surface of the housing 71, an image element 743 included in the imaging information calculation section 74 is provided. The imaging information calculation section 74 is a system for analyzing image data taken by the controller 7 and detecting the position of the center of gravity, the size and the like of an area having a high brightness in the image data. The imaging information calculation section 74 has, for example, a maximum sampling period of about 200 frames/sec., and therefore can trace and analyze even a relatively fast motion of the controller 7. On a rear surface of the housing 70, a connector 73 is provided. The connector 73 is, for example, a 32-pin edge connector, and is used for engaging and connecting the controller 7 with a connection cable. The present example embodiment(s) does not use information from the imaging information calculation section 74, and thus the imaging information calculation section 74 will not be described in further detail.

In order to give a specific description, a coordinate system which is set for the controller 7 will be defined. As shown in FIGS. 3 and 4, X-, Y- and Z-axis directions perpendicular to one another are defined for the controller 7. Specifically, the longitudinal direction of the housing 71, i.e., the front-rear direction of the controller 7, is set as a Z-axis direction. A direction toward the front surface of the controller 7 (the surface having the imaging information calculation section 74) is set as a positive Z-axis direction. The up-down direction of the controller 7 is set as a Y-axis direction. A direction toward the top surface of the housing 71 (the surface having the cross key 72*a* and the like) is set as a positive Y-axis direction. The left-right direction of the controller 7 is set as an X-axis direction. A direction toward a left surface of the housing 71 (the surface which is not shown in FIG. 3 but is shown in FIG. 4) is set as a positive X-axis direction.

Figure 5A:
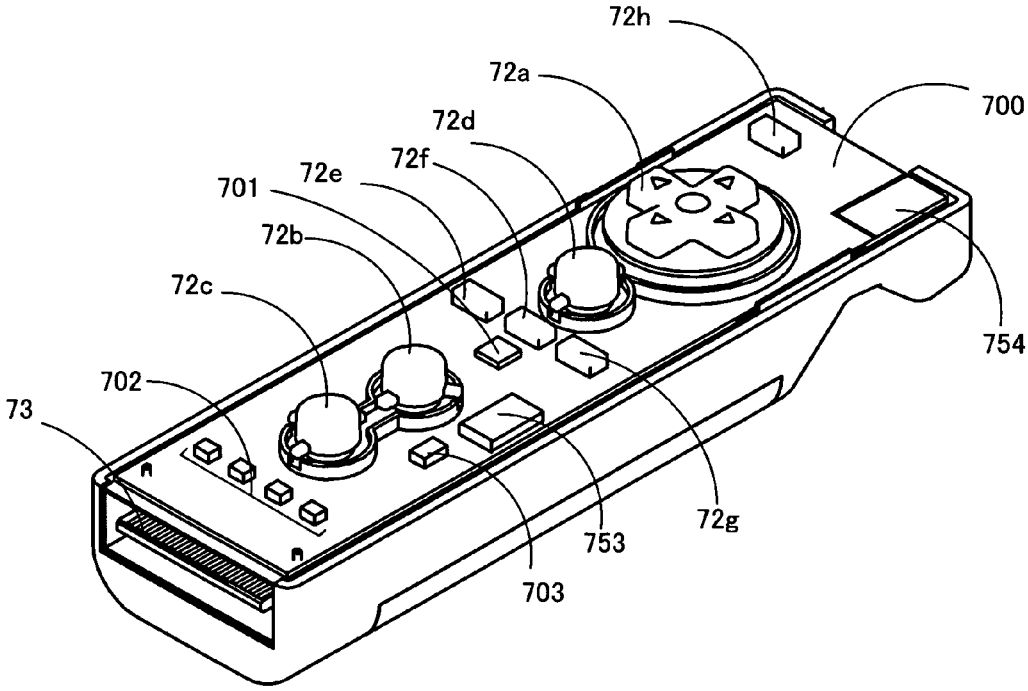
FIG. 5A is a schematic diagrammatic perspective view of the controller 7 in the state where an upper casing is removed.
Figure 5B:
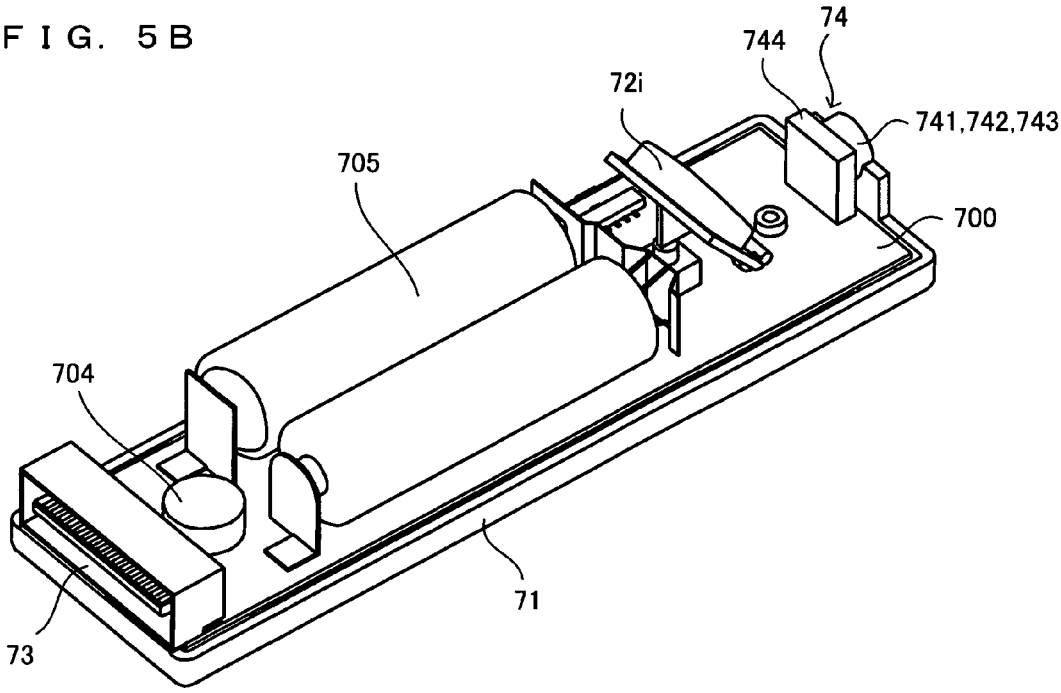
FIG. 5B is a schematic diagrammatic perspective view of the controller 7 in the state where a lower casing is removed.

With reference to FIGS. 5A and 5B, an internal structure of the controller 7 will be described. FIG. 5A is a schematic diagrammatic perspective view illustrating a state where an upper casing (a part of the housing 71) of the controller 7 is removed. FIG. 5B is a schematic diagrammatic perspective view illustrating a state where a lower casing (a part of the housing 71) of the controller 7 is removed. FIG. 5B shows a reverse side of a substrate 700 shown in FIG. 5A.

As shown in FIG. 5A, the substrate 700 is fixed inside the housing 71. On a top main surface of the substrate 700, the operation buttons 72*a* through 72*h*, an acceleration sensor 701, the LEDs 702, a quartz oscillator 703, a wireless module 753, an antenna 754 and the like are provided. These elements are connected to a microcomputer 751 (see FIG. 6) via lines (not shown) formed on the substrate 700 and the like. The acceleration sensor 701 detects and outputs the acceleration which can be used for calculating inclination, oscillation and the like in a three-dimensional space in which the controller 7 is located.

Figure 6:
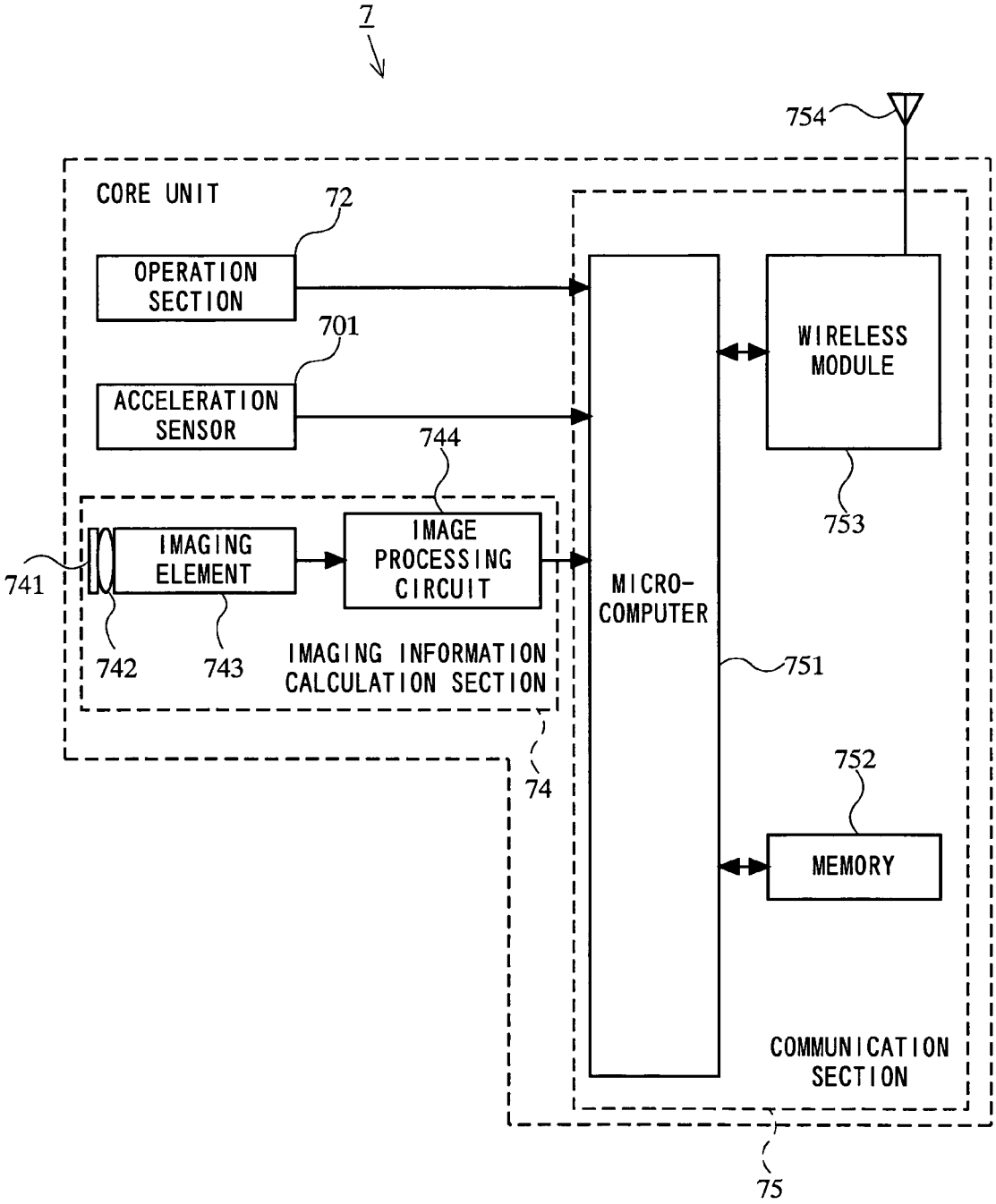
FIG. 6 is a block diagram illustrating a structure of the controller 7 shown in FIG. 3.

More specifically, it is preferable that the controller 7 includes a three-axis acceleration sensor 701, as shown in FIG. 6. The three-axis acceleration sensor 701 detects liner acceleration in each of the three axial directions, i.e., the up-down direction (Y-axis shown in FIG. 3), the left-right direction (X-axis shown in FIG. 3) and the front-rear direction (Z-axis shown in FIG. 3). Alternatively, a two-axis linear accelerometer that only detects linear acceleration along each of the X-axis and Y-axis (or other pair of axes) may be used in another embodiment depending on the type of control signals used in game processing. Still alternatively, an one-axis accelerometer that only detects linear acceleration along any one of X-, Y- and Z-axis may be used in another embodiment depending on the type of control signals used in game processing. For example, the three-axis, two-axis or one-axis acceleration sensor 701 may be of the type available from Analog Devices, Inc. or STMicroelectronics Nev. Preferably, the acceleration sensor 701 is an electrostatic capacitance or capacitance-coupling type that is based on silicon micromachined MEMS (Micro Electro Mechanical Systems) technology. However, any other suitable accelerometer technology (e.g., piezoelectric type or piezoresistance type) now existing or later developed may be used to provide the three-axis, two-axis or one-axis acceleration sensor 701.

Accelerometers, as used in the acceleration sensor 701, are only capable of detecting acceleration (linear acceleration) along a straight line corresponding to each axis of the acceleration sensor 701. In other words, the direct output of the acceleration sensor 701 is signals indicative of linear acceleration (static or dynamic) along each of the one, two or three axes thereof. As a result, the acceleration sensor 701 cannot directly detect movement along a non-linear (e.g., arcuate) path, rotation, rotational movement, angular displacement, tilt, position, attitude or any other physical characteristics.

However, through additional processing of the acceleration signals output from the acceleration sensor 701, additional information relating to the controller 7 can be inferred or calculated (determined), as one skilled in the art will readily understand from the description herein. For example, by detecting static acceleration (gravity acceleration), the output of the acceleration sensor 701 can be used to determine tilt of the object (controller 7) relative to the gravity vector by performing an operation using tilt angles and the detected acceleration. In this way, the acceleration sensor 701 can be used in combination with the microcomputer 751 (or another processor such as the CPU 30 or the like included in the game apparatus 3) to determine tilt, attitude or position of the controller 7. Similarly, various movements and/or positions of the controller 7 can be calculated through processing of the acceleration signals generated by the acceleration sensor 701 when the controller 7 containing the acceleration sensor 701 is subjected to dynamic accelerations by the hand of the player. In another embodiment, the acceleration sensor 701 may include an embedded signal processor or other type of dedicated processor for performing any desired processing for the acceleration signals outputted from the accelerometers therein prior to outputting signals to the microcomputer 751.

A communication section 75 having the wireless module 753 and the antenna 754 allow the controller 7 to act as a wireless controller. The quartz oscillator 703 generates a reference clock of the microcomputer 751 described later.

As shown in FIG. 5B, at a front edge of a bottom main surface of the substrate 700, the imaging information calculation section 74 is provided. The imaging information calculation section 74 includes an infrared filter 741, a lens 742, an imaging element 743 and an image processing circuit 744 located in this order from the front surface of the controller 7. These elements are attached to the bottom main surface of the substrate 700. At a rear edge of the bottom main surface of the substrate 700, the connector 73 is attached. The operation button 72*i* is attached on the bottom main surface of the substrate 700 rearward to the imaging information calculation section 74, and cells 705 are accommodated rearward to the operation button 72*i*. On the bottom main surface of the substrate 700 between the cells 705 and the connector 73, a vibrator 704 is attached the vibrator 704 may be, for example, a vibration motor or a solenoid. The controller 7 is vibrated by an actuation of the vibrator 704, and the vibration is conveyed to the hand of the player holding the controller 7. Thus, a so-called vibration-responsive game is realized.

Next, with reference to FIG. 6, the internal structure of the controller 7 will be described. FIG. 6 is a block diagram showing the structure of the controller 7.

The imaging information calculation section 74 includes the infrared filter 741, the lens 742, the imaging element 743 and the image processing circuit 744. The infrared filter 741 allows only infrared light to pass therethrough, among light incident on the front surface of the controller 7. The lens 742 collects the infrared light which has passed through the infrared filter 741 and outputs the infrared light to the imaging element 743. The imaging element 743 is a solid-state imaging element such as, for example, a CMOS sensor or a CCD, and takes an image of the infrared light collected by the lens 742. Accordingly, the imaging element 743 takes an image of only the infrared light which has passed through the infrared filter 741 and generates image data. The image data generated by the imaging element 743 is processed by the image processing circuit 744. Specifically, the image processing circuit 744 processes the image data obtained from the imaging element 743, detects an area thereof having a high brightness, and outputs processing result data representing the detected coordinate position and size of the area to the communication section 75. The imaging information calculation section 74 is fixed to the housing 71 of the controller 7. The imaging direction of the imaging information calculation section 74 can be changed by changing the direction of the housing 71.

As described above, the acceleration sensor 701 detects and outputs the acceleration in the form of components of three axial directions of the controller 7, i.e., the up-down direction (Y-axis direction), the left-right direction (X-axis direction) and the front-rear direction (z-axis direction) of the controller 7. Data representing the acceleration as the components of the three axial directions detected by the acceleration sensor 701 is outputted to the communication section 75. Based on the acceleration data outputted from the acceleration sensor 701, a tilt or motion of the controller 7 can be determined. As the acceleration sensor 701, an acceleration sensor for detecting an acceleration in two of the three axial directions or an acceleration sensor for detecting an acceleration in one (e.g., Y-axis) of the three axial directions may be used according to data necessary for a specific application.

The communication section 75 includes the microcomputer (Micro Computer) 751, a memory 752, the wireless module 753 and the antenna 754. The microcomputer 751 controls the wireless module 753 for transmitting the transmission data while using the memory 752 as a memory area during processing.

Data from the controller 7 including an operation signal (key data) from the operation section 72, acceleration signal (X-, Y- and Z-axis direction acceleration data) in the three axial directions from the acceleration sensor 701, and the processing result data from the imaging information calculation section 74 are outputted to the microcomputer 751. The microcomputer 751 temporarily stores the input data (key data, X-, Y- and Z-axis direction acceleration data, and the processing result data) in the memory 752 as the transmission data which is to be transmitted to the receiving unit 6. The wireless transmission from the communication section 75 to the receiving unit 6 is performed at a predetermined time interval. Since game processing is generally performed at a cycle of 1/60 sec., the wireless transmission needs to be performed at a cycle of a shorter time period. Specifically, the game processing unit is 16.7 ms (1/60 sec.), and the transmission interval of the communication section 75 structured using the Bluetooth® is 5 ms. With the transmission timing to the receiving unit 6, the microcomputer 751 outputs the transmission data stored in the memory 752 as a series of operation information to the wireless module 753. The wireless module 753 uses, for example, the Bluetooth® technology to radiate the operation information from the antenna 754 as an electric wave signal using a carrier wave signal of a predetermined frequency. Thus, the key data from the operation section 72 provided in the controller 7, the X-, Y- and Z-axis direction acceleration data from the acceleration sensor 701 provided in the controller 7, and the processing result data from the imaging information calculation section 74 provided in the controller 7 are transmitted from the controller 7. The receiving unit 6 of the game apparatus 3 receives the electric wave signal, and the game apparatus 3 demodulates or decodes the electric wave signal to obtain the series of operation information (the key data, X-, Y-, and Z-axis direction acceleration data and the processing result data). Based on the obtained operation information and the game program, the CPU 30 of the game apparatus 3 performs the game processing. In the case where the communication section 75 is structured using the Bluetooth® technology, the communication section 75 can have a function of receiving transmission data which is wirelessly transmitted from other devices.

Figure 7:
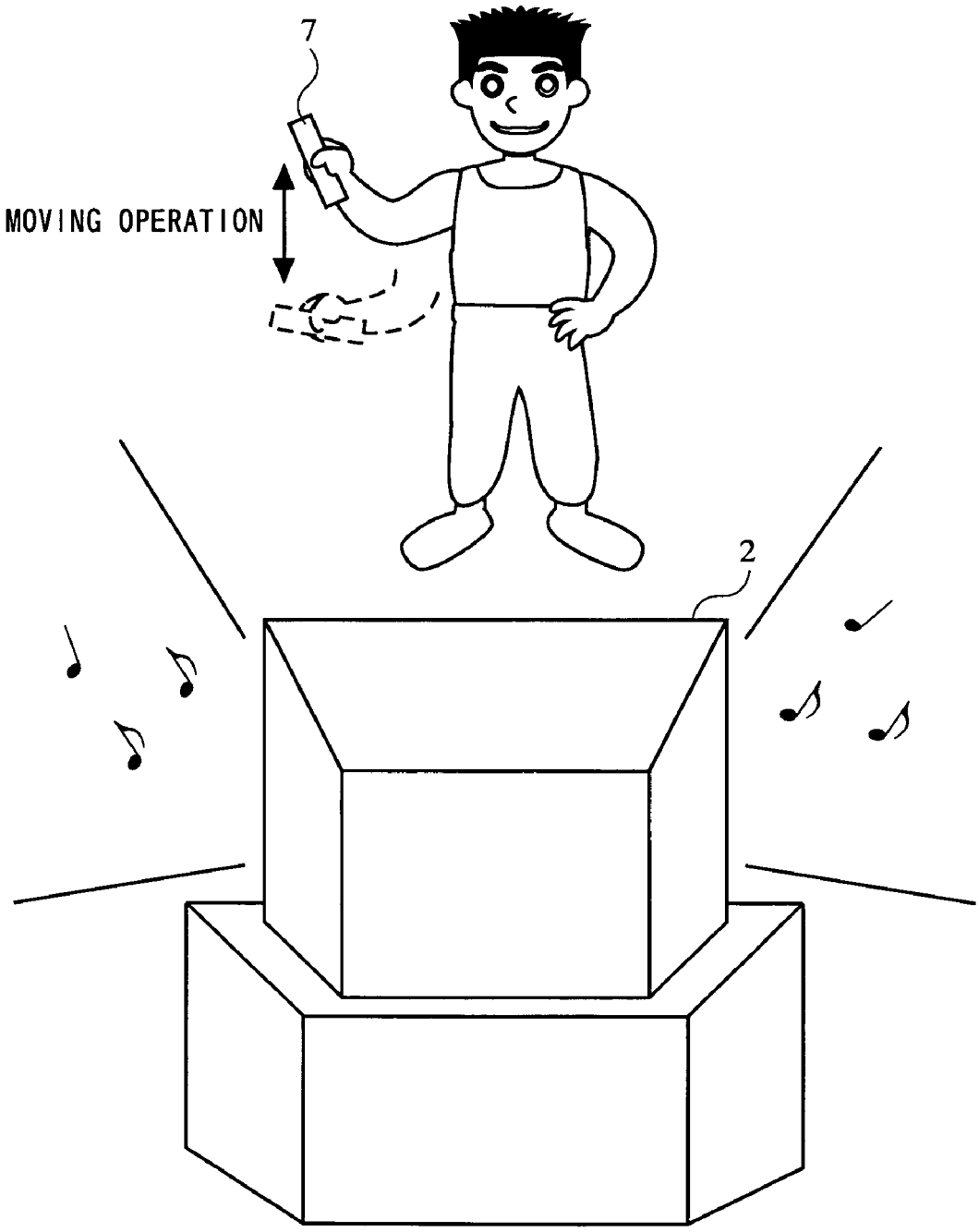
FIG. 7 shows how the controller 7 shown in FIG. 3 is used to perform a game operation.

Next, prior to describing a specific process performed by the game apparatus 3, an outline of a game performed in the present game apparatus 3 will be described. As shown in FIG. 7, the entire controller 7 is small enough to be held by one hand of an adult or even a child. In order to play a game using the controller 7 in the game system 1, the controller 7 is moved like a baton so as to be able to enjoy changes in played music. Specifically, while viewing a game image showing a group of musical instruments (or characters playing the respective musical instruments) represented on the monitor 2, the player moves the controller 7 like a baton so as to cause the followings to be as the player desires: a type and the number of musical instruments (the number of sounds) to be played; a style of playing music (legato or staccato); the number of beats (8 beats or 16 beats); tonality (major key or minor key); tempo in playing music; sound volume; and the like. As such, operation information (specifically, X-, Y-, and Z-axis direction acceleration data) generated by moving the controller 7 by the player is fed from the controller 7 to the game apparatus 3.

Figure 8:
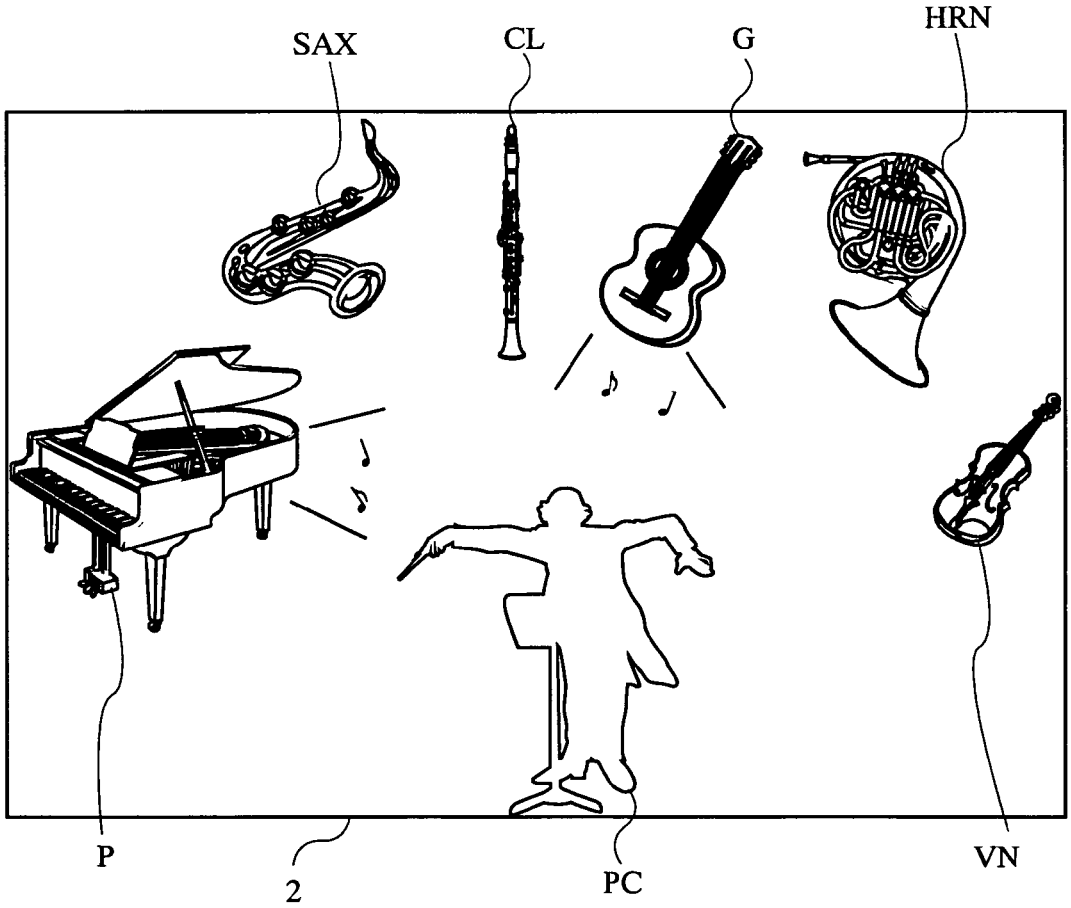
FIG. 8 is a diagram showing an example of a game image displayed on a monitor 2.
Figure 9:
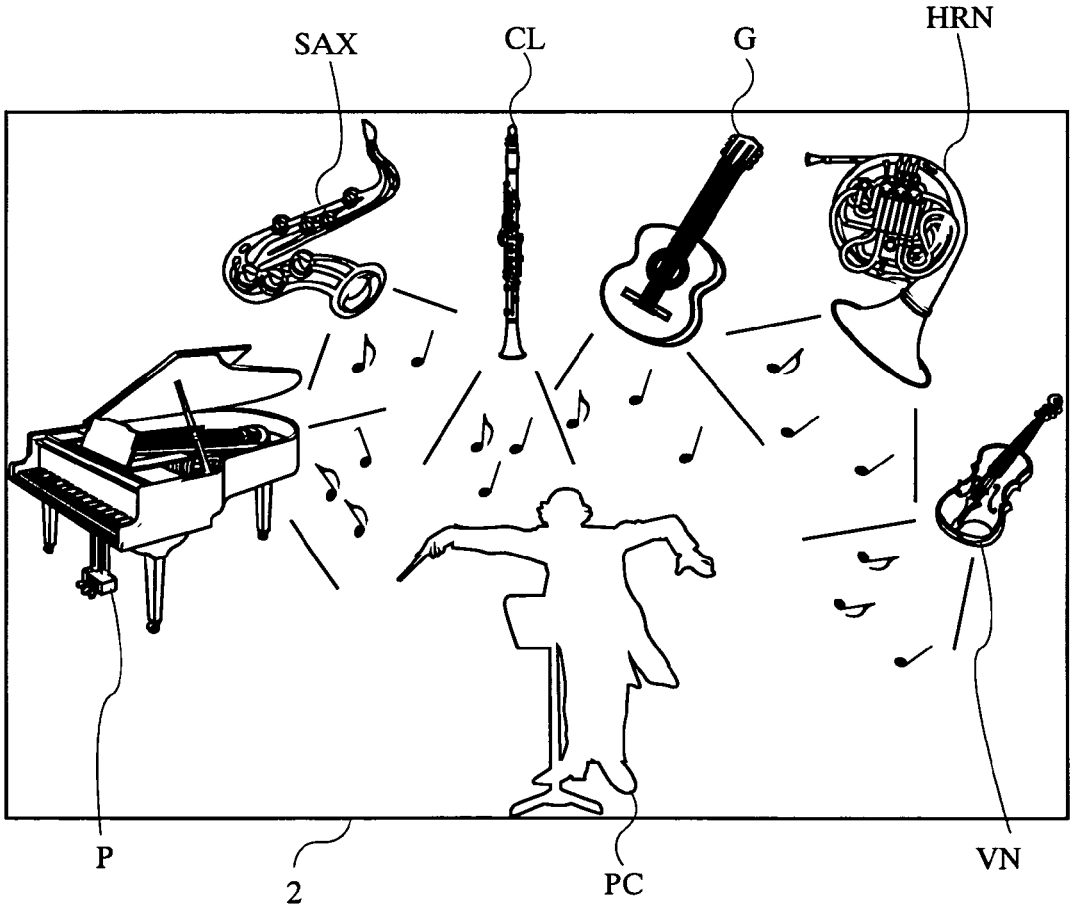
FIG. 9 is a diagram showing another example of a game image displayed on the monitor 2.

For example, as shown in FIGS. 8 and 9, a player character PC and a group of musical instruments (or a group of characters respectively playing the musical instruments) to be conducted by the player character PC are displayed. In an example shown in FIGS. 8 and 9, the piano P, the saxophone SAX, the clarinet CL, the guitar G, the horn HRN, and the violin VN are displayed as an example of the group of musical instruments. The player can change the number and type (the number of sounds) of the musical instruments to play in accordance with sharpness or gentleness in movement of the controller 7, and a game image is so represented on the monitor 2 that the player can recognize the type of played musical instruments, as will be apparent in a later description. A game image exemplarily shown in FIG. 8 indicates a state where the piano P and the guitar G are played in accordance with movement of the controller 7 performed by the player. A game image exemplarily shown in FIG. 9 indicates a state where all musical instruments are played in accordance with movement of the controller 7 performed by the player.

Figure 10A:
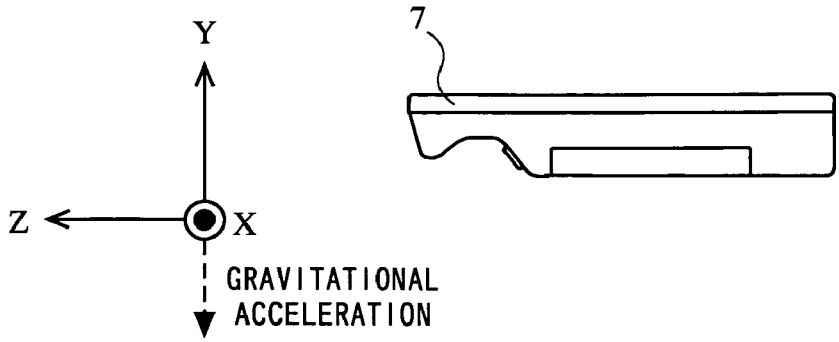
FIG. 10A is a diagram for illustrating a relationship between a state where the controller 7 is horizontally rested and acceleration applied to the controller 7.
Figure 10B:
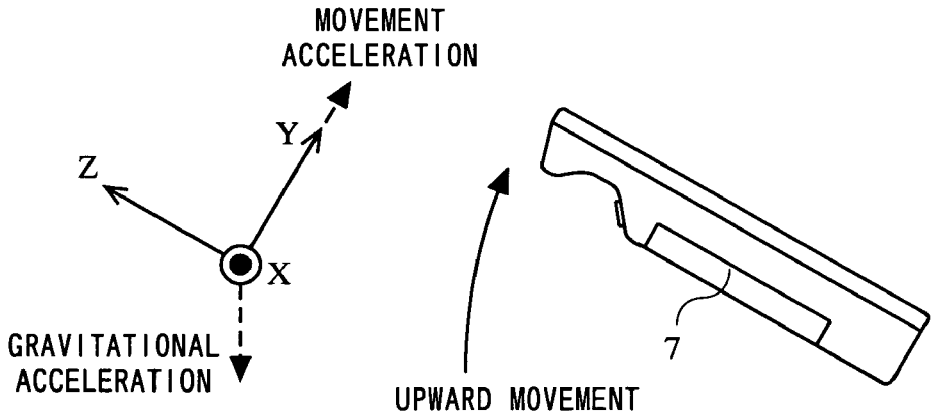
FIG. 10B is a diagram for illustrating a relationship between a state where the controller 7 is moved upward and acceleration applied to the controller 7.
Figure 10C:
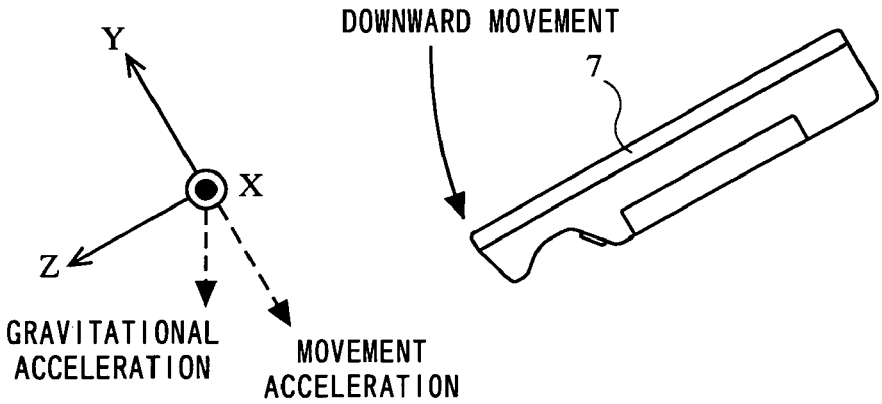
FIG. 10C is a diagram for illustrating a relationship between a state where the controller 7 is moved downward and acceleration applied to the controller 7.

FIGS. 10A to 10C are diagrams illustrating a relationship between a state of moving up or moving down the controller 7 in the up-down direction and acceleration applied to the controller 7. To the controller 7, dynamic acceleration (movement acceleration) generated by the player moving the controller 7 and static gravitational acceleration are applied, and the acceleration sensor 701 detects thereby generated linear accelerations in each of the directions, the up-down direction (Y-axis), the left-right direction (X-axis), and the front-rear direction (Z-axis).

When the player horizontally rests the controller 7 such that the top surface thereof (a surface where the cross key 72*a* is provided) faces upward, gravitational acceleration works in a negative Y-axis direction, as shown in FIG. 10A.

On the other hand, when the player moves the controller 7 in an upward direction, a movement acceleration of positive Y-axis direction is generated, as shown in FIG. 10B. The faster the upward movement of the controller 7 is, the bigger the movement acceleration is. Note that the gravitational acceleration works in both the negative Y-axis direction and a negative Z-axis direction of the controller 7.

When the player moves the controller 7 downward, a movement acceleration is generated in the negative Y-axis direction, as shown in FIG. 10C. The faster the downward movement of the controller 7 is, the bigger the movement acceleration is. Note that the gravitational acceleration works in both the negative Y-axis direction and a positive Z-axis direction of the controller 7.

As such, when the player moves the controller 7, the acceleration sensor 701 detects a dynamic acceleration, in a direction in which the controller 7 is moved, whose magnitude is in accordance with the speed of the movement. However, actual acceleration worked on the controller 7 is not generated in simple directions or magnitudes as shown in FIGS. 10A to 10C. Actually, a centrifugal force or the like due to upward or downward movement of the controller 7 is also applied thereto. Also, directions in which the acceleration is generated due to waving or twisting the controller 7 in the left-right direction by the player vary. In the present embodiment, movement of the controller 7 swung and waved by the player is analyzed by using a magnitude of a resultant vector calculated from linear accelerations, in the three axial directions, detected by the acceleration sensor 701 and a magnitude of a difference resultant vector calculated from differences obtained from each difference in linear accelerations in each of the three axial directions (i.e., changes in acceleration).

Figure 11A:
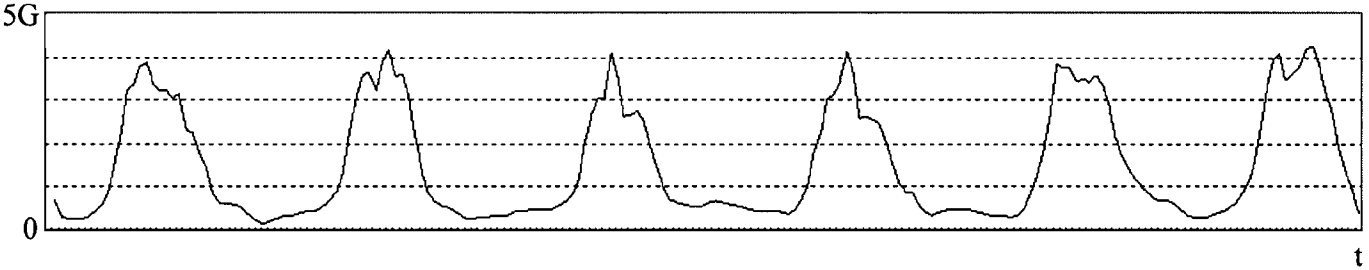
FIG. 11A is a graph showing an example of magnitude changes in a resultant vector which appear when a player expansively moves the controller 7 in time with a counting of a beat in a sharp manner.
Figure 11B:
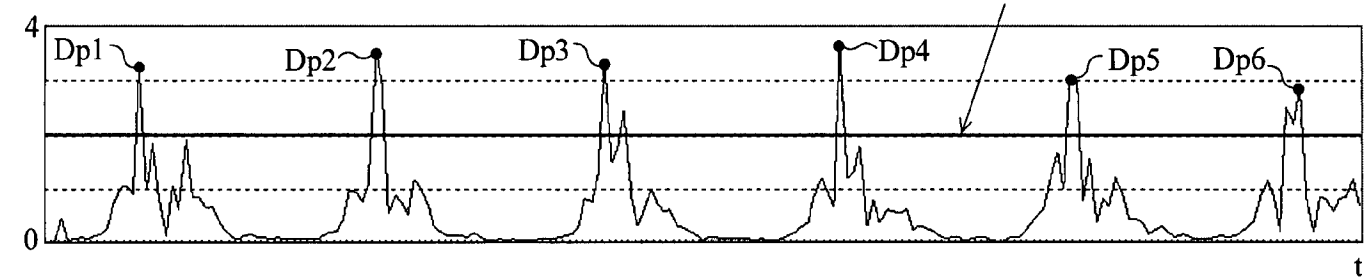
FIG. 11B is a graph showing an example of magnitude changes in a difference resultant vector when the resultant vector shown in FIG. 11A is obtained.
Figure 11C:
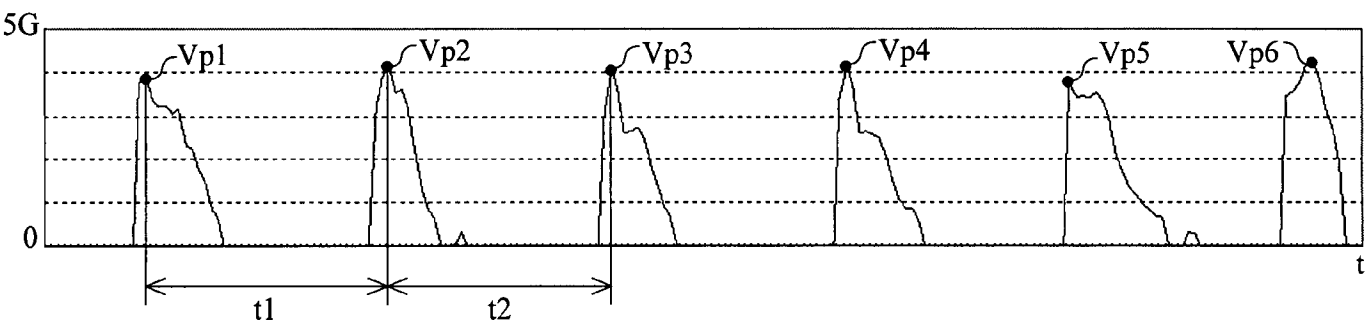
FIG. 11C is a graph, showing an example of magnitude changes in the resultant vector shown in FIG. 11A, in which a magnitude is zero for a duration when a linear acceleration in a positive Y-axis direction is obtained.

FIG. 11A is a graph showing an example of magnitude changes in a resultant vector which appear when the player expansively moves the controller 7 in time with a counting of a beat in a sharp manner. FIG. 11B is a graph showing an example of magnitude changes in a difference resultant vector calculated from a difference in the linear accelerations of the respective three axial directions when the resultant vector shown in FIG. 11A is obtained. FIG. 11C is a graph, showing an example of magnitude changes in the resultant vector shown in FIG. 11A, in which a magnitude is zero for a duration when a linear acceleration in the positive Y-axis direction is obtained for the resultant vector. In FIGS. 11A to 11C, horizontal axes thereof are all in a same time frame.

When accelerations in the X-axis direction, the Y-axis direction, and the Z-axis direction indicated by the acceleration data outputted from the acceleration sensor 701 are Xa, Ya, and Za, respectively, a magnitude V of a resultant vector is calculated with the following Expression 1:

[Expression 1]

$$V=\sqrt{Xa^2+Ya^2+Za^2} \quad (1).$$

When the player moves the controller 7 so as to count a beat with a baton such that, for example, 2 beats or 4 beats are counted, the magnitude V of the resultant vector increases or decreases in accordance with the beat, as shown in FIG. 11A. Specifically, the magnitude V of the resultant vector is greatest with a timing when the controller 7 is moved by the player such that acceleration/deceleration in the movement thereof is performed with a maximum force. The player generally moves the controller 7 in time with a counting of each beat in a sharp manner (e.g., a swift downward motion is suddenly stopped or a swift motion in an upward direction is performed, in time with a counting of a beat), and therefore, the magnitude V of the resultant vector indicates a peak with a timing of each beat.

However, depending on a manner of movement performed by the player, the magnitude V of the resultant vector indicates a peak in discordance with a timing of each beat, in some cases. For example, in a case where a beat is counted when the controller 7 is moved down during a movement in the up-down direction, the magnitude V of the resultant vector may be increased at a time when the movement is shifted from up to down. In addition, when the player moves the controller 7 with a common movement of a baton counting 4 beats, the magnitude V of the resultant vector may increase during a transition between the first beat and the second beat. In order to remove such peaks of the magnitude V of the resultant vector occurring in discordance with a timing of each beat, the magnitude is set V=0 for a duration when the linear acceleration in a predetermined axis direction (e.g., the positive Y-axis direction) is obtained (FIG. 11C). Accordingly, the peaks in the magnitude V due to a component appearing in a direction opposite to the direction of acceleration occurring with a timing of each beat can be removed, and only peak values corresponding with timing of beats can be extracted. Through calculating a time interval between the obtained peak values, tempo of the beat can be calculated. Note that, in FIG. 11C, peak values of the magnitude V of the resultant vector corresponding to the timing of beats are denoted as peak values Vp1 to Vp6 (hereinafter, the peak values may be collectively referred to as a "resultant vector peak value Vp"). The tempo obtained by using the peak values Vp1 and Vp2 is denoted as a time period t1 and the tempo obtained by using the peak values Vp2 and Vp3 is denoted as a time period t2.

When, on the other hand, accelerations in the X-axis direction, the Y-axis direction, and the Z-axis direction previously acquired and indicated by the acceleration data outputted from the acceleration sensor 701 are Xa0, Ya0, and Za0, respectively, a magnitude D of a difference resultant vector is calculated with the following Expression 2:

[Expression 2]

$$D=\sqrt{(Xa-Xa0)^2+(Ya-Ya0)^2+(Za-Za0)^2} \quad (2).$$

As shown in FIG. 11B, when the player moves the controller 7 in a manner of counting a beat, a value of the magnitude D of the difference resultant vector changes according to increase/decrease of the acceleration of the controller 7. Specifically, when the player vigorously moves the controller 7 in a sharp manner of counting a beat, the amount of increase/decrease of the acceleration of the controller 7 is increased and a value of the magnitude D of the difference resultant vector is increased. Generally, a peak of the magnitude D of a difference resultant vector appears immediately prior to a peak of the magnitude V of a resultant vector. FIGS. 11B and 11C show an exemplary state in which peak values Dp1 to Dp6 (hereinafter, the peak values may be collectively referred to as a "difference resultant vector peak value Dp") of the magnitude D of the difference resultant vector appear immediately prior to the resultant vector peak values Vp1 to Vp6.

Figure 12A:
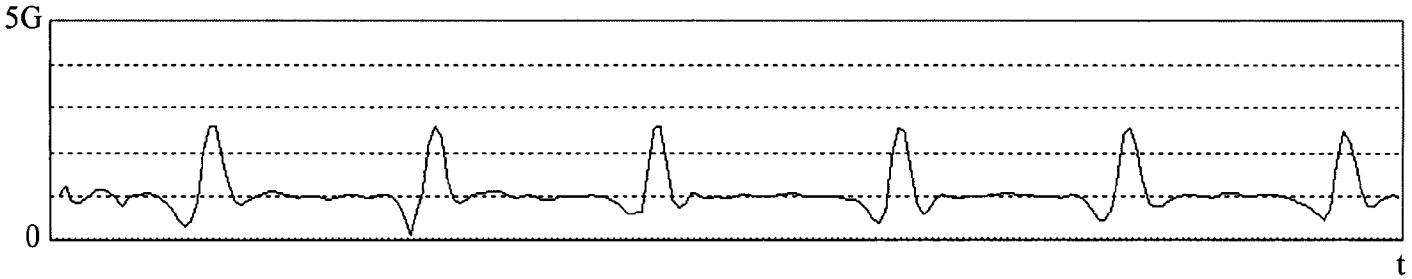
FIG. 12A is a graph showing an example of magnitude changes in a resultant vector which appear when the player restrictively moves the controller 7 in time with a counting of a beat in a sharp manner.
Figure 12B:
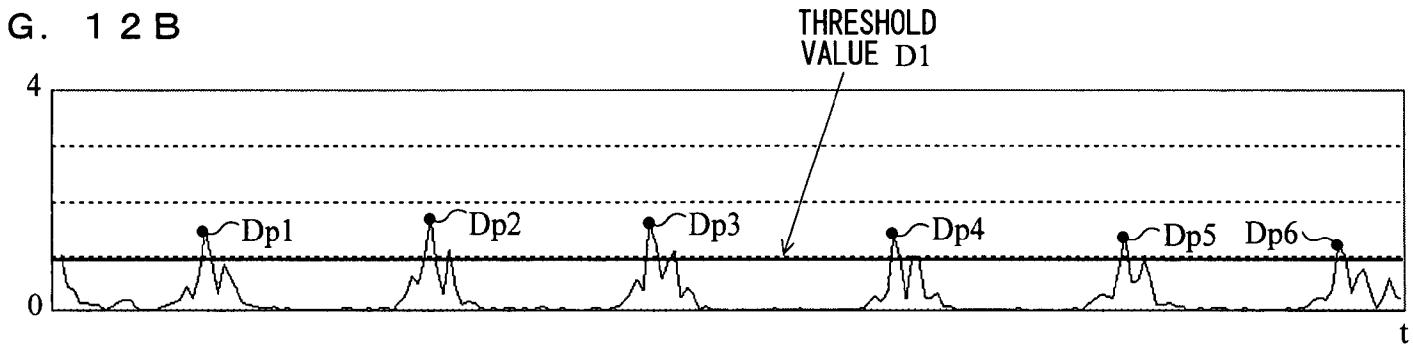
FIG. 12B is a graph showing an example of magnitude changes in a difference resultant vector when the resultant vector shown in FIG. 12A is obtained.
Figure 12C:
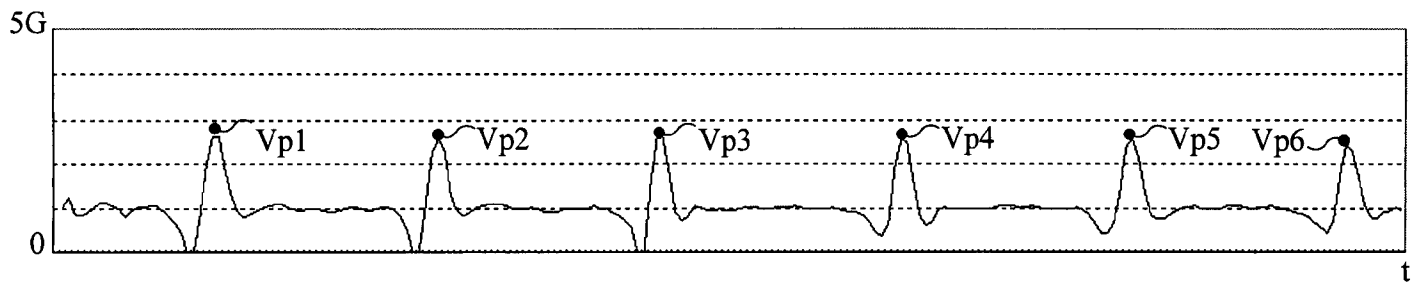
FIG. 12C is a graph, showing an example of magnitude changes in the resultant vector shown in FIG. 12A, in which a magnitude is zero for a duration when a linear acceleration in the positive Y-axis direction is obtained.
Figures 13A, 13B, 13C:
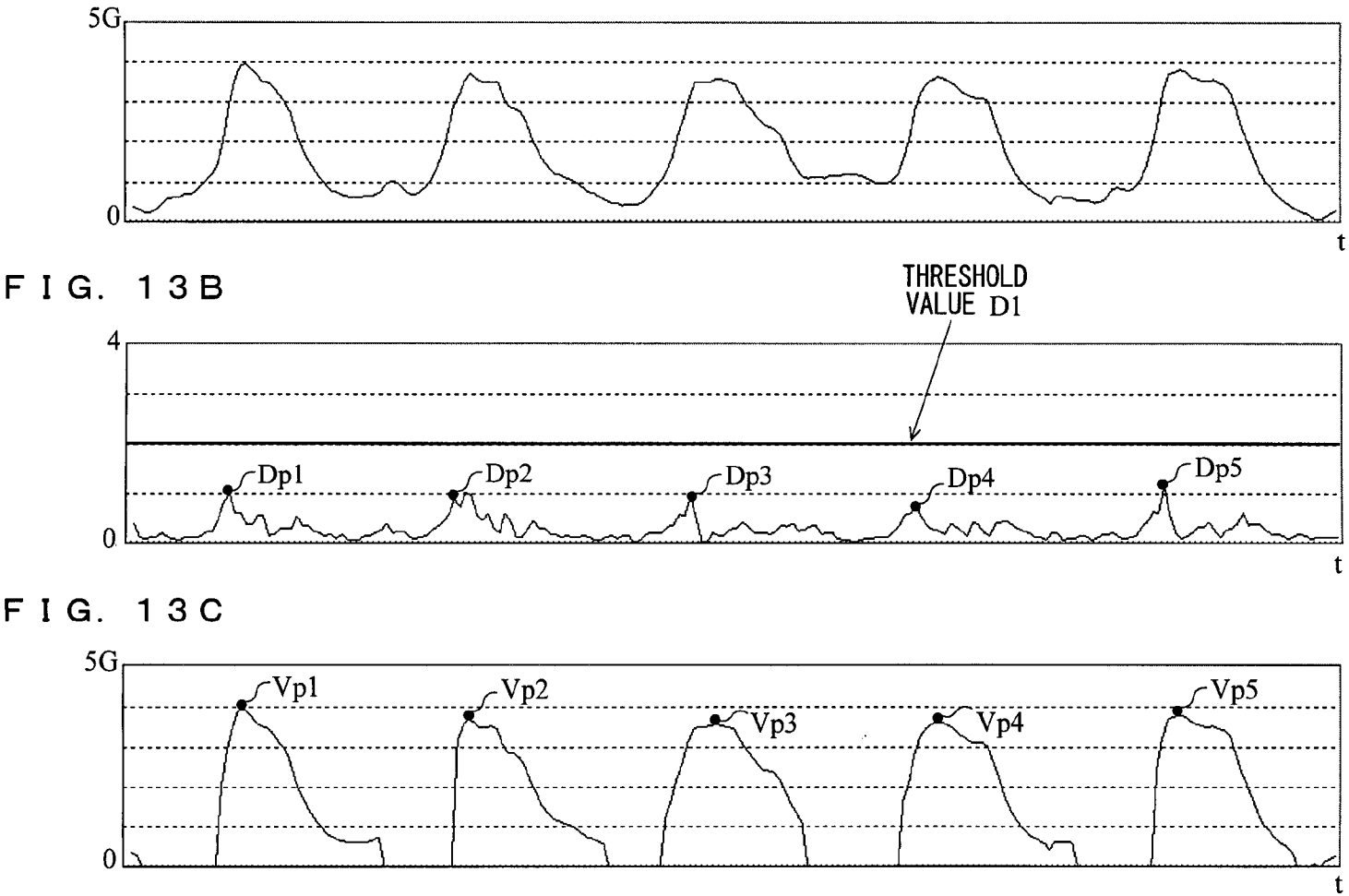
FIG. 13A is a graph showing an example of magnitude changes in a resultant vector which appear when the player expansively moves the controller 7 in time with a counting of a beat in a gentle and less sharp manner.
FIG. 13B is a graph showing an example of magnitude changes in a difference resultant vector when the resultant vector shown in FIG. 13A is obtained.
FIG. 13C is a graph, showing an example of magnitude changes in the resultant vector shown in FIG. 13A, in which a magnitude is zero for a duration when a linear acceleration in the positive Y-axis direction is obtained.
Figure 14A:
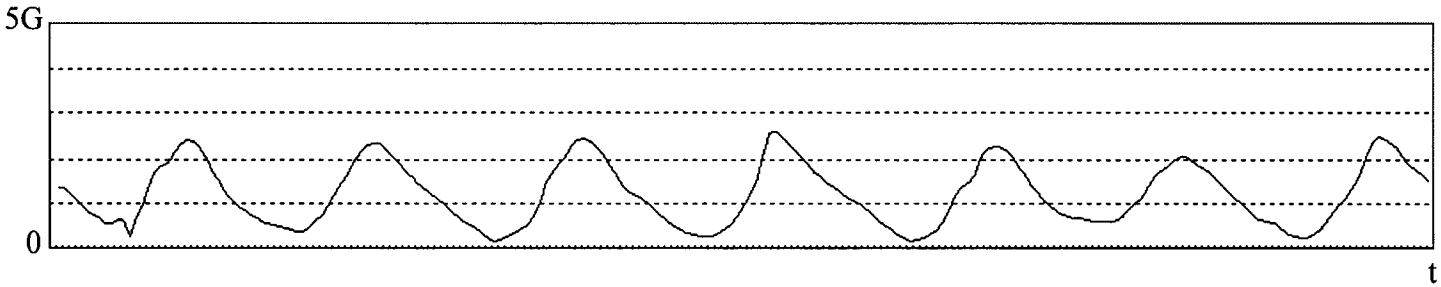
FIG. 14A is a graph showing an example of magnitude changes in a resultant vector which appear when the player restrictively moves the controller 7 in time with a counting of a beat in a gentle and less sharp manner.
Figure 14B:
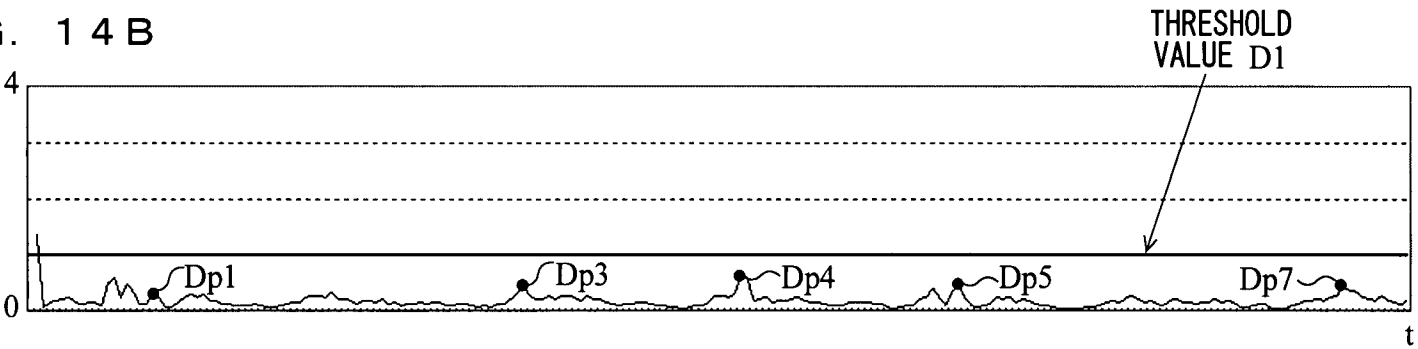
FIG. 14B is a graph showing an example of magnitude changes in a difference resultant vector when the resultant vector shown in FIG. 14A is obtained.
Figure 14C:
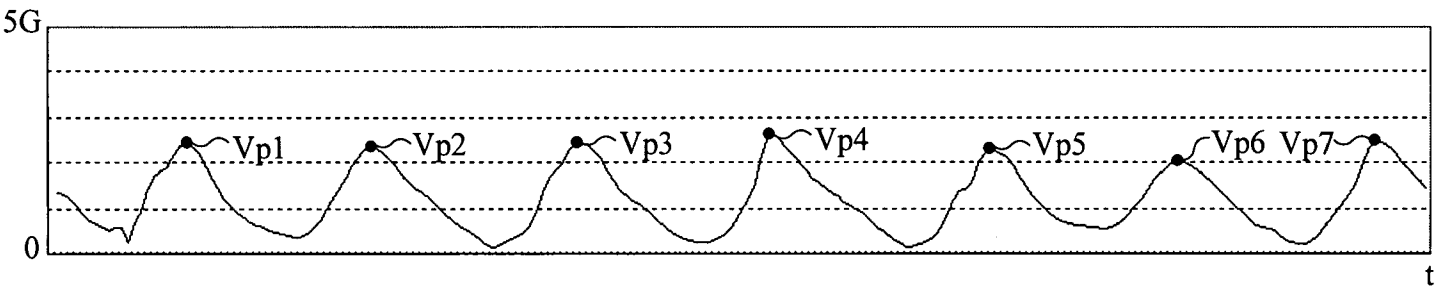
FIG. 14C is a graph, showing an example of magnitude changes in the resultant vector shown in FIG. 14A, in which a magnitude is zero for a duration when a linear acceleration in the positive Y-axis direction is obtained.

Hereinafter, with reference to FIGS. 11 to 14, described is an example of the magnitude V of a resultant vector and the magnitude D of a difference resultant vector generated in accordance with a style of movement of the controller 7 performed by the player. Specifically, described is the magnitude V of a resultant vector and the magnitude D of a difference resultant vector generated when the player changes magnitude and gentleness (the presence or absence of sharpness) of movement of the controller 7. FIG. 12A is a graph showing an example of magnitude changes of a resultant vector which appear when the player restrictively moves the controller 7 in time with a counting of a beat in a sharp manner. FIG. 12B is a graph showing an example of magnitude changes in a difference resultant vector calculated from a difference in linear accelerations in each of the three axial directions when the resultant vector shown in FIG. 12A is obtained. FIG. 12C is a graph, showing an example of magnitude changes in the resultant vector shown in FIG. 12A, in which the magnitude is zero for a duration when a linear acceleration in the positive Y-axis direction is obtained for the resultant vector. FIG. 13A is a graph showing an example of magnitude changes in a resultant vector which appear when the player expansively moves the controller 7 in time with a beat in a gentle and less sharp manner. FIG. 13B is a graph showing an example of magnitude changes of a difference resultant vector calculated from a difference in linear accelerations in each of the three axial directions when the resultant vector shown in FIG. 13A is obtained. FIG. 13C is a graph, showing an example of magnitude changes in the resultant vector shown in FIG. 13A, in which the magnitude is zero for a duration when a linear acceleration in the positive Y-axis direction is obtained for the resultant vector. FIG. 14A is a graph showing an example of magnitude changes in a resultant vector which appear when the player restrictively moves the controller 7 in time with a counting of a beat in a gentle and less sharp manner. FIG. 14B is a graph showing an example of magnitude changes in a difference resultant vector calculated from a difference in linear accelerations in each of the three axial directions when the resultant vector shown in FIG. 14A is obtained. FIG. 14C is a graph, showing an example of magnitude changes in the resultant vector shown in FIG. 14A, in which the magnitude is zero for a duration when a linear acceleration in the positive Y-axis direction is obtained for the resultant vector.

When peak values Vp (peak values Vp in FIGS. 11C and 13C) obtained by expansively moving the controller 7 are compared with peak values Vp (peak values Vp in FIGS. 12C and 14C) obtained by restrictively moving the controller 7, the peak values Vp obtained by expansively moving the controller 7 are greater. The reason therefor is conceived that, when the controller 7 is moved with a same tempo for both the expansive movement and the restrictive movement, relatively expansive movement requires fast transition of the controller 7, and thus, detected acceleration thereof is large. Accordingly, by using peak values Vp, a magnitude of movement of the controller 7 performed by the player can be determined.

On the other hand, when peak values Dp (peak values Dp in FIG. 11B) obtained by expansively moving the controller 7 in time with a counting of a beat in a sharp manner are compared with peak values Dp (peak values Dp in FIG. 13B) obtained by moving the controller 7 in a gentle and less sharp manner, the peak values Dp obtained by moving the controller 7 in a sharp manner are greater. Also, when peak values Dp (peak values Dp in FIG. 12B) obtained by restrictively moving the controller 7 in time with a counting of a beat in a sharp manner are compared with peak values Dp (peak values Dp in FIG. 14B) obtained by moving the controller 7 in a gentle and less sharp manner, the peak values Dp obtained by moving the controller 7 in a sharp manner are greater. Accordingly, by using peak values Dp, gentleness (the presence or absence of sharpness) in movement of the controller 7 performed by the player can be determined.

Here, when the peak values Dp (the peak values Dp in FIG. 12B) obtained by restrictively moving the controller 7 in a sharp manner are compared with the peak values Dp (the peak values Dp in FIG. 13B) obtained by expansively moving the controller 7 in a gentle manner, the difference therebetween is small so that making a distinction therebetween is difficult. However, the peaks are distinguished by the magnitude of movement determined using the peak values Vp, and therefore, gentleness/sharpness of the movement can be determined by using peak values Dp when a determination reference (threshold D1) for the peak values Dp is changed by the peak values Vp.

In the present embodiment, by using acceleration data, a magnitude of movement of the controller 7 performed by the player, gentleness/sharpness of the movement, and the like are determined. Based on the determination result, music performance (the number and types of musical instruments to be played, a style of playing music, the number of beats, tonality, and the like) is changed. As such, the player can change expression (articulation) in a piece of music, based on movement of the controller 7. Further, tempo in playing music is changed in accordance with timing of the movement of the controller 7 performed by the player, and sound volume is changed in accordance with magnitude of acceleration in the movement.

Figure 15:
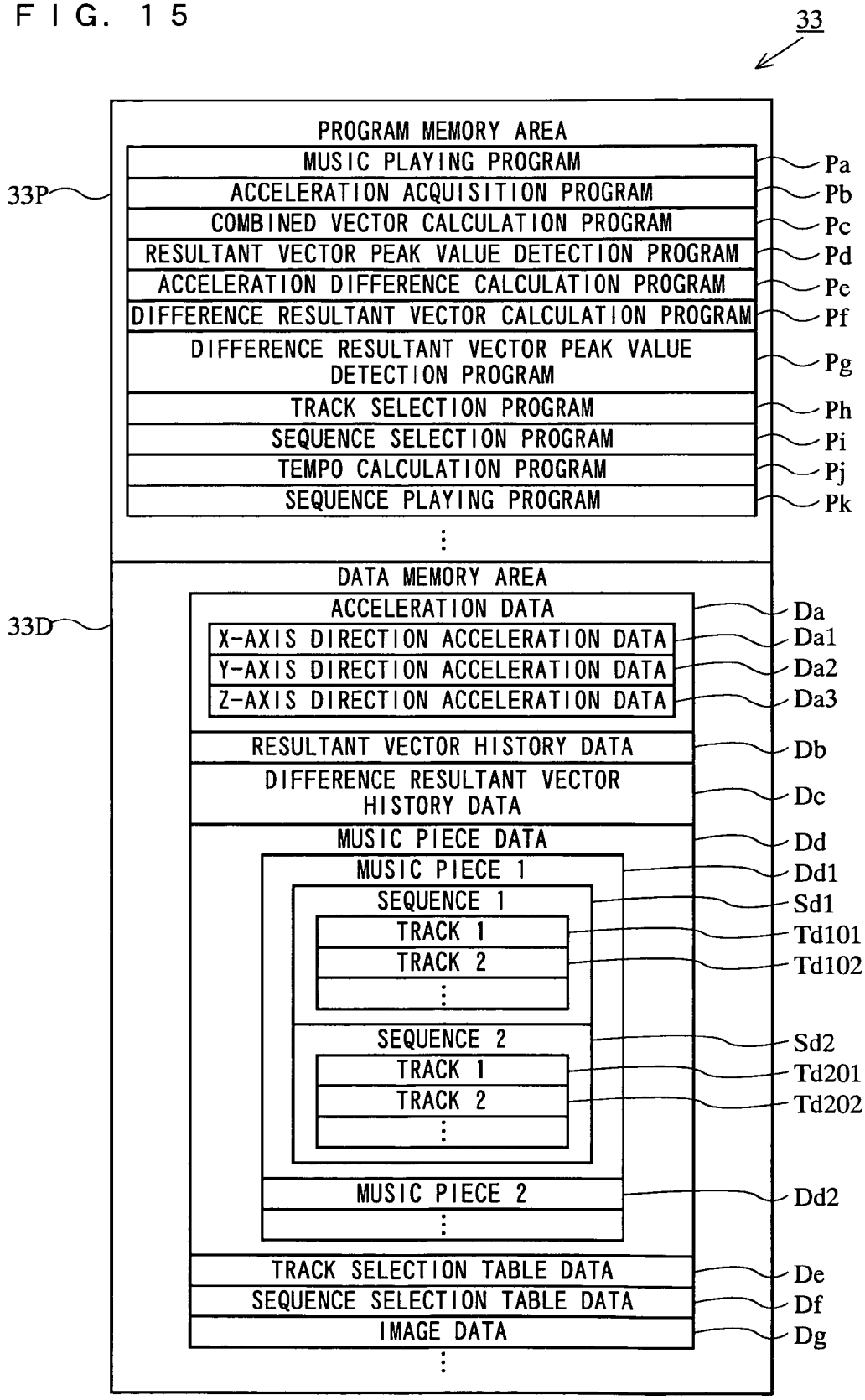
FIG. 15 is a diagram showing main programs and data stored in a main memory 33 of the game apparatus 3.
Figure 17:
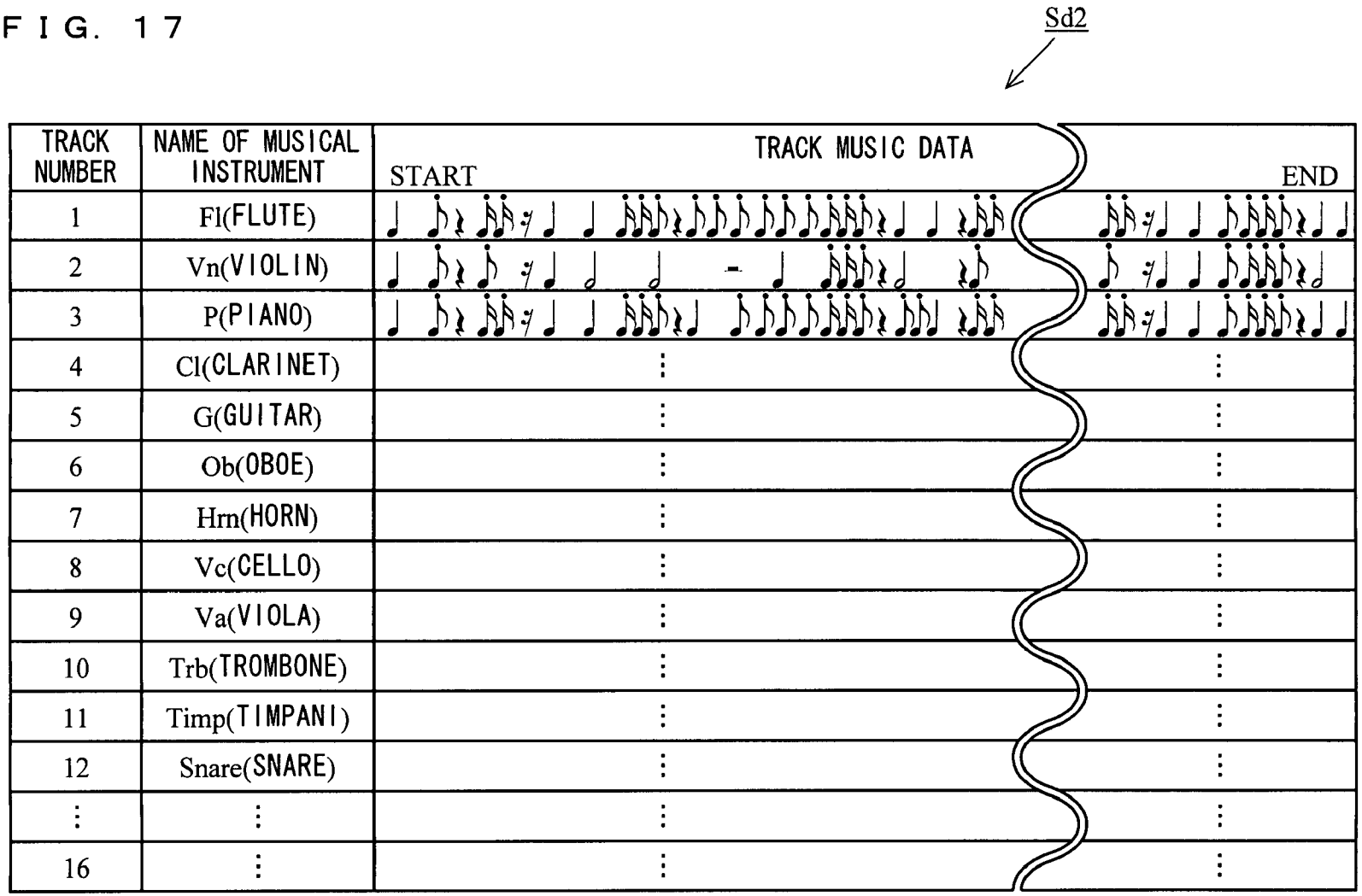
FIG. 17 is a diagram showing another example of sequence data.

Next, a music performance process performed in the game system 1 is described in detail. With reference to FIGS. 15 to 19, main programs and data used in the music performance process are first described. FIG. 15 is a diagram showing main programs and data stored in the main memory 33 of the game apparatus 3. FIG. 16 is a diagram showing an example of sequence data. FIG. 17 is a diagram showing another example of sequence data. FIG. 18 is a diagram showing an example of a track selection table. FIG. 19 is a diagram showing an example of a sequence selection table.

As shown in FIG. 15, in the main memory 33, a program memory area 33P and a data memory area 33D are set. In the program memory area 33P, stored are: a music playing program Pa; an acceleration acquisition program Pb; a resultant vector calculation program Pc; a resultant vector peak value detection program Pd; an acceleration difference calculation program Pe; a difference resultant vector calculation program Pf; a difference resultant vector peak value detection program Pg; a track selection program Ph; a sequence selection program Pi; a tempo calculation program Pj; a sequence playing program Pk; and the like. In the data memory area 33D, stored are: acceleration data Da; resultant vector history data Db; difference resultant vector history data Dc; music piece data Dd; track selection table data De; sequence selection table data Df; image data Dg; and the like. Note that, in the main memory 33, in addition to data included in information shown in FIG. 15, stored are data required for a game process such as: data for a player character PC, other characters, or the like appearing in a game (position data or the like); data for a virtual game space (background data or the like); and the like.

The music playing program Pa is a program for defining the entire music performance process (later described steps 51 to 70; hereinafter, only a step number corresponding to the program is provided). Through starting an execution of the music playing program Pa, the music performance process is started. The acceleration acquisition program Pb defines a process (step 54) of receiving and acquiring acceleration data transmitted from the controller 7. The resultant vector calculation program Pc defines a process (step 55) of calculating a magnitude of a resultant vector based on the acquired acceleration data. The resultant vector peak value detection program Pd defines a process (step 61) of detecting a peak value in the calculated magnitude of the resultant vector, based on a predetermined peak detection algorithm. The acceleration difference calculation program Pe defines a process (step 57) of calculating a difference between the acquired acceleration data and acceleration data previously acquired. The difference resultant vector calculation program Pf defines a process (step 58) of calculating a magnitude of a difference resultant vector by using the difference calculated for each axis. The difference resultant vector peak value detection program Pg defines a process (step 64) of detecting a peak value in the calculated magnitude of the difference resultant vector, based on a predetermined peak detection algorithm. The track selection program Ph defines a process (step 63) of selecting a track to play, in accordance with a peak value in a magnitude of a resultant vector. The sequence selection program Pi defines a process (steps 66 and 70) of selecting a sequence to play, in accordance with a peak value or a maximum value in a magnitude of a difference resultant vector. The tempo calculation program Pj defines a process (step 67) of determining timing of beats in accordance with a time interval between peak values in a magnitude of a resultant vector. The sequence playing program Pk defines a process (step 68) of playing music in music data in accordance with the selected sequence data and track data, based on set music performance parameters.

The acceleration data Dais acceleration data contained in a series of operation information transmitted from the controller 7 as transmission data. The acceleration data Da includes X-axis direction acceleration data Da1, Y-axis direction acceleration data Da2, and Z-axis direction acceleration data Da3, each of which is detected by the acceleration sensor 701 for each corresponding component of three axes, X-, Y-, and Z-axis. The receiving unit 6 included in the game apparatus 3 receives acceleration data contained in the operation information transmitted, from the controller 7, with respect to each predetermined time interval, e.g., 5 ms, and stores the received acceleration data in a buffer (not shown) included in the receiving unit 6. Thereafter, the stored acceleration data is read with respect to each predetermined period for the music performance process or by one frame each, which is a game processing time interval. Then, the acceleration data Da in the main memory 33 is updated. In the present example, most recent acceleration data transmitted from the controller 7 and acceleration data acquired immediately previous thereto are sufficient to be stored in the acceleration data Da, but acceleration data of predetermined past frames may be stored.

The resultant vector history data Db is data in which a history of a magnitude of a calculated resultant vector corresponding to a predetermined time period is recorded. The difference resultant vector history data Dc is data in which a history of a magnitude of a calculated difference resultant vector is recorded for a predetermined time period.

The music piece data Dd includes, for example, music control data in MIDI format, and includes a plurality of pieces of music piece data Dd1, Dd2, and so on. The music piece data Dd1, Dd2, and so on respectively include a plurality of pieces of sequence data. In FIG. 15, sequence data Sd1 and Sd2 included in the music piece data Dd1 are shown as an example. Hereinafter, with reference to FIGS. 16 and 17, the sequence data Sd1 and Sd2 are described.

In the sequence data Sd1 and Sd2 in FIGS. 16 and 17, a plurality of musical instruments are allocated to a plurality of tracks (channels) called MIDI channels so that a track number assigned each of the musical instruments can be used to designate a corresponding musical instrument for selectively controlling operations of the plurality of musical instruments. That is, in the sequence data Sd1 and Sd2, a track (channel) is allocated to a part (a musical instrument) in music. The sequence data Sd1 and Sd2 are used so as to play music with the plurality of musical instruments by the DSP 34 and the ARAM 35 (sound sources). The above-described sound sources have tones respectively corresponding to the musical instruments, and a tone is allocated to each track such that the tones for tracks are different from each other, so as to output a sound of a tone of a musical instrument corresponding to a designated track number. Then, the above-described sound sources reproduce sound of a piece of music with a pitch, tone, and sound volume designated based on the music performance parameters instructed by the CPU 30 and with a designated tempo.

Specifically, the sequence data Sd1 have track data Td101 to Td116 of 16 tracks, and the sequence data Sd2 have track data Td201 to Td216 of 16 tracks. In each of the tracks, a track number, a name of a musical instrument, and track music data are written. In each of the track data Td, a different musical instrument is allocated to each track number such that track number "1" corresponds to the flute, track number "2" corresponds to the violin, track number "3" corresponds to the piano, and track music data for the respective musical instruments is written therein. The track music data is musical note information including: information indicating an onset of sound output (note on) and an offset of sound output (note off) for each of the musical instruments; information indicating a pitch of the sound; information indicating an intensity level of the sound output; and the like. Through being instructed of a track number and track music data corresponding to a play timing of music, the DSP 34 and the ARAM 35 can reproduce musical sound of a predetermined tone.

The sequence data Sd1 and Sd2 are data indicating a same piece of music, but track music data different in a style of playing music are written therein, as an example. For example, in the sequence data Sd1 shown in FIG. 16, track music data for a smooth style of playing music (Legato) is written such that each of the musical instruments (tracks) outputs sounds in a smooth and continuous manner. On the other hand, in the sequence data Sd2 shown in FIG. 17, track music data for a sharp style of playing music (Staccato) is written such that each of the musical instruments outputs sounds in a distinctly separate manner so as to play only notes that are appropriate in an interpretation of the music.

As alternative setting examples for the sequence data Sd1 and Sd2, for example, track music data of 8 beats maybe written in the sequence data Sd1 and track music data of 16 beats may be written in the sequence data Sd2. As such, even with a same piece of music, track music data different in the number of beats may be respectively written in the sequence data Sd1 and Sd2. Also, track music data in a minor key may be written in the sequence data Sd1 and track music data in a major key may be written in the sequence data Sd2. As such, even with a same piece of music, track music data different in tonality may be respectively written in the sequence data Sd1 and Sd2. Accordingly, even with a same piece of music, track music data different in articulation of the piece of music are respectively written in the sequence data Sd1 and Sd2. Note that three or more pieces of sequence data Sd may be set for a single piece of music. In this case, a selection sequence table described later is set so as to have three or more sections, so that the present example embodiment(s) can be similarly realized.

As described above, a piece of the music piece data Dd includes the sequence data Sd each of which differs in a style of playing music, the number of beats, tonality, or the like. Each of the sequence data Sd includes the track data Td each of which differs in a musical instrument to be played.

The track selection table data De is table data indicating a track number to be selected in accordance with a peak value in a magnitude of a resultant vector, and is set with respect to each piece of music to be played. Hereinafter, with reference to FIG. 18, an example of the track selection table data De is described.

In FIG. 18, to-be-selected track numbers corresponding to the resultant vector peak values Vp are written in a track selection table to be stored as the track selection table data De. For example, according to the track selection table, when the resultant vector peak value Vp is less than a threshold value V1, track numbers "1", "3", and "5" are selected. When the resultant vector peak value Vp is equal to or more than the threshold value V1 and less than a threshold value V2, track numbers "1" to "3", "5", "10", and "12" are selected, according to the track selection table. When the resultant vector peak value Vp is equal to or greater than the threshold value V2 and less than a threshold value V3, track numbers "1" to "3", "5", "7", "8", "10", "12", "15", and "16" are selected, according to the track selection table. When the resultant vector peak value Vp is equal to or greater than the threshold value V3, all track numbers (i.e., track numbers "1" to "16") are selected, according to the track selection table.

The sequence selection table data Df is table data indicating a sequence number to be selected in accordance with a peak value in a magnitude of a difference resultant vector, and is set with respect to each piece of music to be played. Hereinafter, with reference to FIG. 19, an example of the sequence selection table data Df is described.

In FIG. 19, to-be-selected sequence numbers corresponding to the difference resultant vector peak values Dp are written in a sequence selection table to be stored as the sequence selection table data Df. For example, when the difference resultant vector peak value Dp is less than a threshold value D1, sequence number "Sd1" is selected according to the sequence selection table. When the difference resultant vector peak value Dp is equal to or greater than the threshold value D1, sequence number "Sd2" is selected according to the sequence selection table.

The image data Dg includes player character image data, other character image data, and the like. The image data Dg is data for arranging a player character or other characters in a virtual game space, thereby generating an game image.

Figure 20:
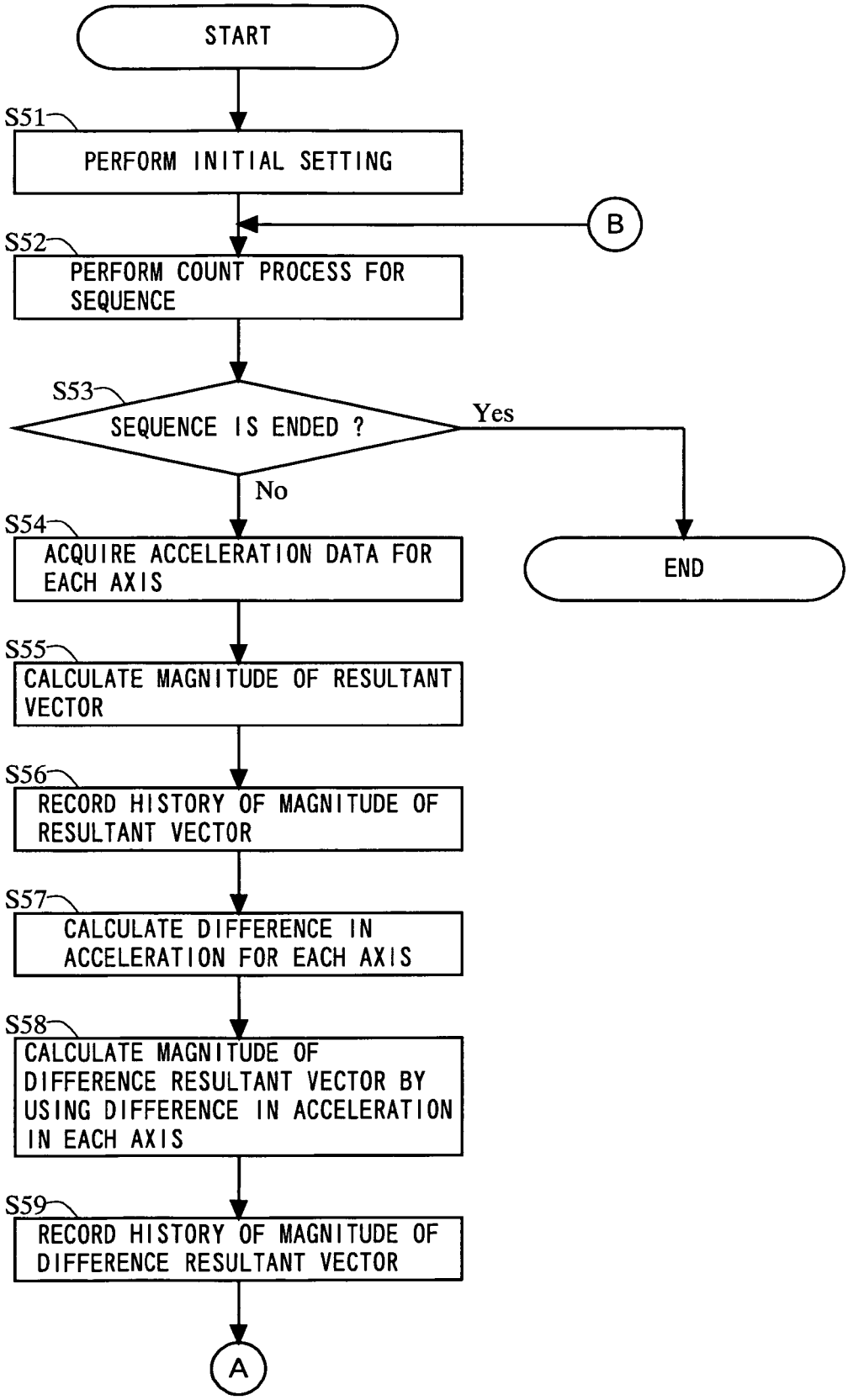
FIG. 20 is a flowchart showing a first half of a flow of a music performance process to be executed in the game apparatus 3.
Figure 21:
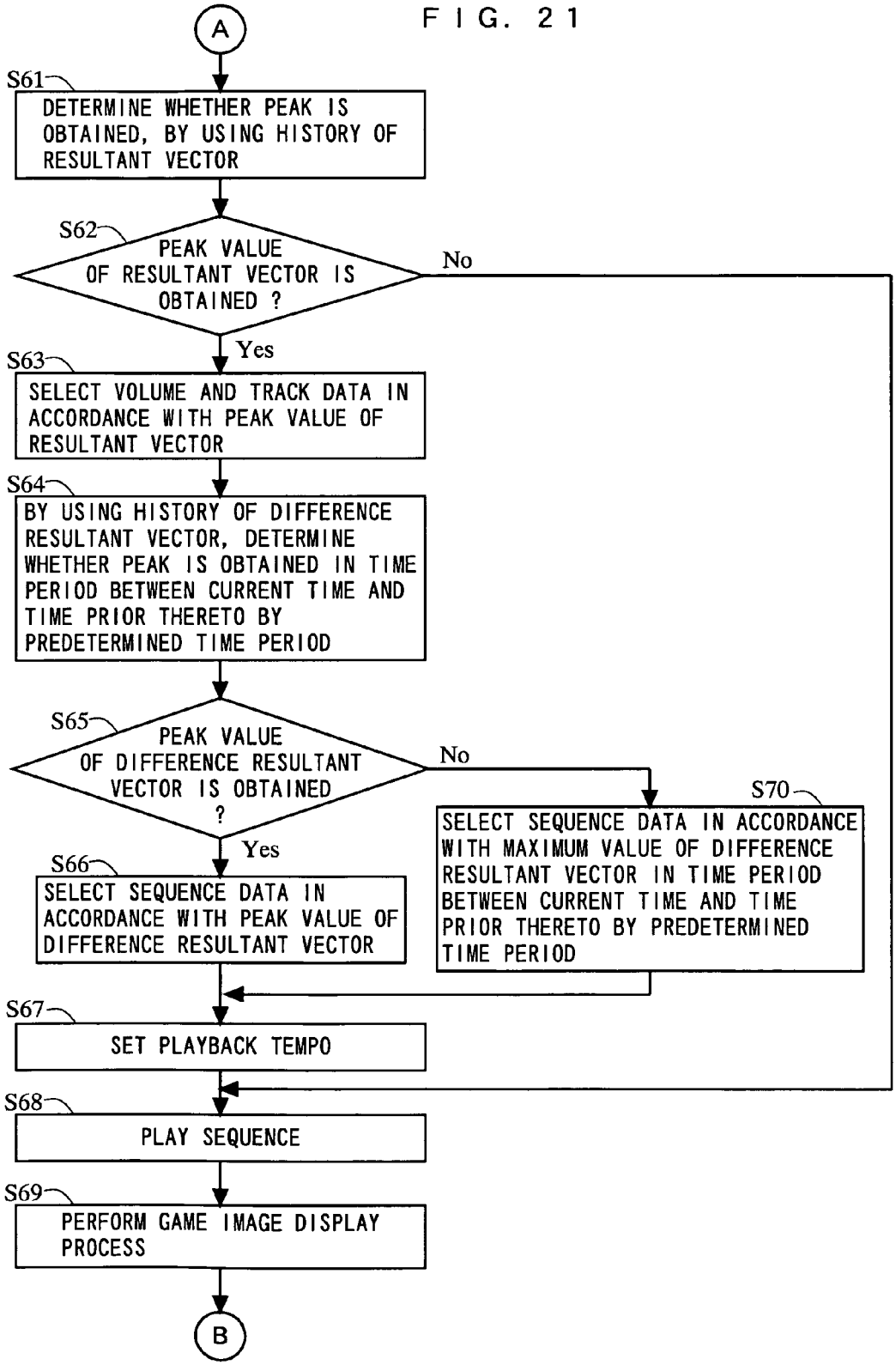
FIG. 21 is a flowchart showing a last half of the flow of the music performance process to be executed in the game apparatus 3.

Next, with reference to FIGS. 20 and 21, a detail of the music performance process performed in the game apparatus 3 is described. FIG. 20 is a flowchart showing a first half of a flow in the music performance process to be executed in the game apparatus 3. FIG. 21 is a flowchart showing a last half of the flow in the music performance process to be executed in the game apparatus 3. Note that in the flowcharts shown in FIGS. 20 and 21, the game process for the music performance process is described, and a detailed description for the game process not directly relating to the present example embodiment(s) is omitted. In FIGS. 20 and 21, each step executed by the CPU 30 is abbreviated and referred to as "S".

When the power of the game apparatus 3 is turned on, the CPU 30 of the game apparatus 3 executes a startup program stored in a boot ROM not shown, thereby initializing each unit in the main memory 33 and the like. Then, a game program stored in the optical disk 4 is read into the main memory 33, and the CPU 30 starts executing the game program. The flowcharts shown in FIGS. 20 and 21 show the music performance process performed after completion of the above processes.

In FIG. 20, the CPU 30 performs initial setting (step 51) for performing the music performance process, and the process proceeds to the next step. For example, the CPU 30 selects, as an initial setting, a piece of music to be subjected to the music performance process, and extracts music piece data corresponding to the selected piece of music from the music piece data Dd. Also, the CPU 30 sets a default value to sequence data and track data representing a target music to play.

Next, the CPU 30 performs a count process for a sequence (step 52) so as to determine whether or not the sequence is ended (step 53). When the sequence data representing the target music to play is counted until the last thereof, the CPU 30 determines that the sequence is ended, and ends the process of the flowchart. On the other hand, when counting for the sequence data representing the target music to play is in progress, the process of the CPU 30 proceeds to next step 54. The count process performed in step 52 is a process for, when track music data is sequentially read out from the sequence data (see FIGS. 16 and 17), setting a count value so as to indicate a timing in the track music data from which the reading should be started. The speed of counting a count value changes in accordance with a set timing of beats. In the present embodiment, sequence data representing a target music to play changes in accordance with an operation of the player, as will be apparent from a later description. Accordingly, a count value set in the count process performed in step 52 is for a plurality of pieces of sequence data (i.e., a plurality of pieces of sequence data belonging to same music piece data) which are potential targets for music performance. In other words, simultaneous and parallel counting is performed for the plurality of pieces of sequence data.

In step 54, the CPU 30 acquires acceleration data, for each axis, included in operation information received from the controller 7, and the process proceeds to the next step. The CPU 30 then stores the acquired acceleration data in the main memory 33 as the acceleration data Da. The acceleration data acquired in step 54 includes X-, Y-, and Z-axis direction acceleration data detected by the acceleration sensor 701 for each component of three axes, X-, Y-, and Z-axis. Here, the communication section 75 transmits, with respect to each predetermined time interval (e.g., 5 ms), the operation information to the game apparatus 3, and a buffer (not shown) included in the receiving unit 6 stores at least the acceleration data. Then, the CPU 30 acquires the acceleration data stored in the buffer with respect to each predetermined period for the music performance process or by one frame, which is a game processing unit, each, for storing the acquired acceleration data to the main memory 33. When acceleration data most recently acquired is stored in the main memory 33, the acceleration data Da is updated such that at least the acceleration data Da acquired and stored immediately previous thereto is kept therein, that is, the latest two pieces of acceleration data are constantly stored therein.

Next, the CPU 30 calculates the magnitude V of a resultant vector by using the X-axis direction acceleration data Da1, the Y-axis direction acceleration data Da2, and the Z-axis direction acceleration data Da3 which are obtained in step 54 (step 55). Specifically, the CPU 30 calculates the magnitude V by using the above-described Expression (1), where Xa is an acceleration indicated by the X-axis direction acceleration data Da1, Ya is an acceleration indicated by the Y-axis direction acceleration data Da2, and Za is an acceleration indicated by the Z-axis direction acceleration data Da3. Then, the CPU 30 records the calculated magnitude V as most recent data of the resultant vector history data Db (step 56), and the process proceeds to the next step. Here, when the Y-axis direction acceleration data Da2 indicates an acceleration in the positive Y-axis direction, the CPU 30 records the magnitude as V=0. Peak in the magnitude V generated in a direction opposite to a direction of acceleration generated with a timing of beats are thereby removed, as described above. Through recording the magnitude as V=0, it is possible to extract in later described step 61 only peak values in accordance with a timing of beats.

Next, the CPU 30 calculates a difference in accelerations in each axis by using: the X-axis direction acceleration data Da1, the Y-axis direction acceleration data Da2, and the Z-axis direction acceleration data Da3 which are obtained in step 54; and the X-axis direction acceleration data Da1, the Y-axis direction acceleration data Da2, and the Z-axis direction acceleration data Da3 which are previously acquired (step 57). Then, the CPU 30 calculates the magnitude D of a difference resultant vector by using the difference in the accelerations in each of the axes (step 58). Specifically, the CPU 30 calculates the magnitude D by using the above-described Expression (2), where Xa0 is an acceleration indicated by the previously acquired X-axis direction acceleration data Da1, Ya0 is an acceleration indicated by the previously acquired Y-axis direction acceleration data Da2, and Za0 is an acceleration indicated by the previously acquired Z-axis direction acceleration data Da3. Then, the CPU 30 records the calculated magnitude D as most recent data of the difference resultant vector history data Dc (step 59), and the process proceeds to the next step shown in FIG. 21.

The CPU 30 refers to a history of the magnitude V of the resultant vector recorded as the resultant vector history data Db, and determines whether or not a peak of the magnitude V of the resultant vector is obtained (step 61). In order to detect peaks in the magnitude V of the resultant vector, a peak detection algorithm already known may be used. When a peak of the magnitude V of the resultant vector is obtained ("Yes" instep 62), the process of the CPU 30 proceeds to next step 63. On the other hand, when a peak of the magnitude V of the resultant vector is not obtained ("No" in step 62), the process of the CPU 30 proceeds to next step 68.

In step 63, the CPU 30 selects a sound volume and track data in accordance with the detected resultant vector peak value Vp, and the process proceeds to the next step. Sound volume for music (dynamics) is one of the music performance parameters, and the CPU 30 sets a sound volume in accordance with the resultant vector peak value Vp such that, for example, when the resultant vector peak value Vp is relatively large, the sound volume is increased. The CPU 30, for example, refers to the resultant vector peak value Vp of the past, and obtains a weighted average for which a most recent peak value Vp is weighted with a predetermined value for calculating the sound volume.

In selecting track data in step 63, a plurality of threshold values (for example, three threshold values V1, V2, and V3; 0<V1<V2<V3<maximum value possible) are set in a range of numerical values that the resultant vector peak value Vp can take. Then, track data (Td) to be selected is determined in accordance with the relationship between the threshold values and the detected resultant vector peak value Vp. For example, the CPU 30 refers to a track selection table (FIG. 18), of a piece of music to be played, in the track selection table data De for determining a track number to be selected in accordance with the resultant vector peak value Vp. As described above, a different musical instrument is allocated in each piece of the track data Td and track music data corresponding to the musical instrument is written therein. Accordingly, through selecting track data, the number and types of musical instruments for a piece of music to be played are selected.

The resultant vector peak value Vp is a parameter for which a value thereof is increased as the player rapidly and expansively moves the controller 7. Accordingly, increasing the number of tracks to be selected as the resultant vector peak value Vp becomes greater, as in the example shown in FIG. 18, is equivalent to increasing the number and types of musical instruments to be played in accordance with rapid and expansive movement of the controller 7 performed by the player. As such, by moving the controller 7, the player is given an impression that the articulation of the played piece of music is changed, thereby providing the player a real sense as if the player performs conducting.

Selection of track data in step 63 is performed with reference to the track selection table, but track data may be selected in a different manner. For example, by setting a numerical expression for calculating the number of to-be-selected tracks n, where the resultant vector peak value Vp is a variable, the number of to-be-selected tracks n is calculated based on an acquired resultant vector peak value Vp. Then, arbitrary track data corresponding to the calculated number of to-be-selected tracks n or track data of track numbers "1" to "n" may be selected from the sequence data Sd representing a target music to play.

Next, the CPU 30 refers to a history of the magnitude D of the difference resultant vector recorded as the difference resultant vector history data Dc, and determines whether or not a peak is obtained in the magnitude D of the difference resultant vector in a time period between a current time and a time prior thereto by a predetermined time period (e.g., eight frames) (step 64). In order to detect a peak of the magnitude D of a difference resultant vector also, a known peak detection algorithm may be used. When a peak of the magnitude D of the difference resultant vector is obtained ("Yes" in step 65), the process of the CPU 30 proceeds to next step 66. On the other hand, when a peak of the magnitude D of the difference resultant vector is not obtained, the process of the CPU 30 proceeds to next step 70.

In step 66, the CPU 30 selects, in accordance with the detected difference resultant vector peak value Dp, sequence data representing a target music to play, and the process proceeds to next step 67. Specifically, for example, at least one threshold value D1 is set in a range of numerical values that the difference resultant vector peak value Dp can take. The threshold value D1 linearly changes, within the previously set range between a maximum value D1max and a minimum value D1min, according to a peak value Vp. For example, a volume value Vm indicating a magnitude of movement of the controller 7 is calculated with the following expression:

$$Vm = Vp/(\text{a maximum value that the magnitude } V \text{ can take}); \text{ and the threshold value } D1 \text{ is obtained by:}$$

$$D1 = D1\text{min} + (D1\text{max} - D1\text{min}) \times Vm;$$

thereby changing the threshold value D1 to be between the maximum value D1max and the minimum value D1min. As the above-described difference between the peak value Dp of FIG. 12B and the peak value Dp of FIG. 13B, the difference between peak values Dp may appear small, depending on a magnitude of movement of the controller 7. However, by changing the threshold value D1 to be a small value when a peak value Vp is relatively small, it is possible to correctly determine gentleness/sharpness of the movement of the controller 7 based on the peak value Dp.

Then, the CPU 30 determines, in accordance with the relationship between the threshold value D1 and the detected difference resultant vector peak value Dp, sequence data (Sd) to be selected. For example, the CPU 30 refers to a sequence selection table (FIG. 19), for a piece of music to be played, in the sequence selection table data Df, and determines a sequence number to be selected in accordance with the difference resultant vector peak value Dp. As described above, the sequence data Sd are data which indicate a same piece of music but are written with track music data different in style of playing music, the number of beats, tonality, and the like. Accordingly, by selecting sequence data, a style of playing music, the number of beats, tonality, and the like are selected.

Here, the difference resultant vector peak value Dp is a parameter for which a value thereof is increased as the player moves the controller 7 in time with a beat in a sharp manner. For example, in examples shown in FIGS. 16, 17, and 19, as the difference resultant vector peak value Dp becomes greater, sequence data is selected such that a smooth style of playing music is changed to a sharp style of playing music. Accordingly, by moving the controller 7 in a sharp manner, the player is given an impression that the articulation of the played piece of music is changed, thereby providing the player a real sense as if the player performs conducting.

On the other hand, in step 70, the CPU 30 refers to a history of the magnitude D of the difference resultant vector recorded as the difference resultant vector history data Dc, and selects sequence data representing a target music to play, in accordance with a maximum value of the magnitude D of the difference resultant vector in a time period between a current time and a time prior thereto by a predetermined time period,. Then, the process proceeds to next step 67. Depending on the manner of movement of the controller 7 performed by the player, for example, a peak of the magnitude D of the difference resultant vector may not appear immediately before the resultant vector peak value Vp is detected. For example, as shown in FIGS. 14B and 14C, when the player restrictively moves the controller 7 in time with a counting of a beat in a gentle and less sharp manner, a peak of the magnitude D of the difference resultant vector does not appear in a time period between a time when the difference resultant vector peak value Vp5 occurs and a time when the peak value Vp6 occurs. Under such a situation, a maximum value of the magnitude D within the time period is used for selecting sequence data representing a target music to play. A method for selecting sequence data representing a target music to play in accordance with the maximum value of the magnitude D is similar to the selection method using the peak value Dp, and therefore, a detailed description therefor is omitted.

In step 67, the CPU 30 calculates a time interval (see t1 and t2 in FIG. 11C) between an occurrence of a peak of the magnitude V of the resultant vector previously obtained and an occurrence of a peak of the magnitude V of the resultant vector currently obtained, and sets a playback tempo using the time interval. Then, the process proceeds to next step 68. Specifically, the CPU 30 sets timing of beats, which is one of the music performance parameters, such that a playback tempo to be slow when the calculated time interval is relatively long. For example, the CPU 30 refers to a time interval previously calculated and obtains a weighted average for which a time interval most recently calculated is weighted with a predetermined value for calculating timing of beats.

In step 68, the CPU 30 performs controlling based on the set music performance parameters for playing music in the currently selected sequence data and track data representing a target music to play contained in the music piece data Dd. The process then proceeds to the next step. Specifically, the CPU 30 sets a sound volume, timing of beats, and the like based on the current music performance parameters. Also, the CPU 30 reads information from the selected track music data in accordance with the count value counted in step 52. Then, the sound sources (DSP34 and ARAM35) allocate a previously set tone to each piece of the read track music data, and reproduces sound from the speakers 2a based on the music performance parameters. Accordingly, a piece of music is played with a predetermined tone according to an operation of the player moving the controller 7.

Here, when the player did not move the controller 7 in step 68, timing of beats (playback tempo) may be set zero at a time of last beat in the sequence data Sd, and playing the piece of music may be stopped. Also, when the controller 7 is started to be moved after the music playing is stopped, a time indicated by a peak of the magnitude V of the resultant vector and an onset of a beat in the sequence data Sd are matched, and the playing the piece of music may be started.

Next, the CPU 30 sets a character to be played, in accordance with the currently selected track data, and generates a game image (see FIGS. 8 and 9) representing a state in which the character is playing music and the player character PC is conducting with a baton in accordance with a timing of beats for displaying on the monitor 2 (step 69), for example. Then, the process of the CPU 30 returns to step 52 and repeats the steps.

As such, track data representing a target music to play for a piece of music including a plurality of pieces of track data is changed in accordance with a magnitude of acceleration detected by an acceleration sensor. Accordingly, music performance can be changed in accordance with the moving operation of the controller 7 performed by the player. For example, by allocating a different musical instrument to each piece of track data, a type of musical instruments to be used for playing music can be changed, causing various changes in music performance, thereby providing the player an entertaining setting where the player feels as if the player is conducting with the baton. Also, for a piece of music having been set with a plurality of pieces of sequence data having a plurality of pieces of track data, sequence data representing a target music to play is changed in accordance with a magnitude of acceleration detected by an acceleration sensor. For example, by writing, in each piece of the sequence data, music data different in a style of playing music, the number of beats, tonality, and the like, articulation in the music can be changed in accordance with the moving operation of the controller 7 performed by the player. Accordingly, it is possible to cause a variety of changes in music performance.

Note that, changed in step 66 or 70 in accordance with the detected difference resultant vector peak value Dp or a maximum value of the magnitude D is sequence data representing a target music to play, but track data representing a target music to play may be changed. Because the sequence data Sd includes groups of track data as shown in FIGS. 15 to 17, selection of a piece of sequence data from a plurality of pieces of sequence data is technically the same as selection of a track data group from a plurality of track data groups. For example, when a plurality of pieces of track data are included in the sequence data Sd such as shown in FIG. 16, the plurality of pieces of track data are grouped into a plurality of track data groups, and one of the track data groups is selected. Then, track data representing the target music to play is determined by, for example, limiting the track data selected in step 63 to track data belonging to the selected track data group, or changing track data which belongs to the selected track data group by using a predetermined scheme, or alternatively, selecting track data from the selected track data in step 63. Accordingly, similar to sequence data formed to be different in music articulation, a plurality of track data groups are formed to be different from each other in music articulation with respect to track data, whereby the present example embodiment(s) can be realized similarly.

Further, it is described that the above-described music piece data Dd includes, for example, music control data in MIDI format, but may include data in a different format. For example, track music data included in each piece of track data may include PCM (Pulse Code Modulation) data or waveform information (streaming information) obtained by recording live performance of a musical instrument allocated to each track. In this case, controlling of a playback tempo becomes difficult. However, when a well-known time compression technique for changing a playback tempo without changing pitch of the sound is used, it is similarly possible to control the playback tempo in accordance with a timing of beats obtained by an operation of the controller 7.

Also, when an acceleration, in the Y-axis direction, detected by the controller 7 is the positive Y-axis direction, the magnitude V of the resultant vector is set zero so as to remove a component generated in a direction opposite to the acceleration occurring with a timing of beats. However, a similar process may be performed by detecting acceleration in a positive/negative direction in the other axes or acceleration in a positive/negative direction in a plurality of axes.

Also, it is described that the acceleration sensor 701 provided in the controller 7 uses a three-axis acceleration sensor for detecting acceleration in three axes perpendicular to each other for output. However, the present example embodiments (s) can be realized when an acceleration sensor for detecting acceleration in at least two axes perpendicular to each other is used. For example, even when an acceleration sensor for detecting acceleration in a three dimensional space where the controller 7 is arranged by dividing the acceleration into two axes, X-axis and Y-axis, (see FIGS. 3 and 4) for output is used, it is possible to determine the operation of the player moving the controller 7 like a baton in the up-down and left-right directions. Further, even when an acceleration sensor for detecting acceleration in one axial direction is used, the present example embodiment(s) can be realized. For example, even when an acceleration sensor for detecting acceleration in an Y-axis component (see FIGS. 3 and 4) in the three dimensional space where the controller 7 is arranged for output is used, it is possible to determine the operation of the player moving the controller 7 like a baton in the up-down direction.

Also, in the above description, the controller 7 is connected to the game apparatus 3 with wireless communications, but the controller 7 may be electrically connected to the game apparatus 3 via a cable. In this case, the cable connected to the controller 7 is connected to a connection terminal of the game apparatus 3.

Also, it is described that a reception means for receiving transmission data wirelessly transmitted from the controller 7 is the receiving unit 6 connected to the connection terminal of the game apparatus 3. However, a reception module provided inside of a main body of the game apparatus 3 may be used for the reception means. In this case, transmission data received by the reception module is outputted to the CPU 30 via a predetermined bus.

Also, the above-described shapes, the number, setting positions, and the like of the controller 7 and the operation section 72 provided therein are exemplary and other shapes, the number, and setting positions thereof may of course be used to realize the present example embodiment(s). Also, the position of the imaging information calculation section 74 (an opening for incident light of the imaging information calculation section 74) in the controller 7 may not be the front surface of the housing 71, and may be provided to another surface as long as light can be introduced thereto from the external area of the housing 71.

The storage medium having a music playing program according to the present example embodiment(s) stored therein and the music playing apparatus therefor are operable to change track data representing a target music to play in accordance with a magnitude of acceleration detected by an acceleration sensor, with respect to a piece of music having a plurality of pieces of track data, thereby being effective as an apparatus or a program for playing music in accordance with movement of an input device or the like.

While the example embodiment(s) have been described in detail, the foregoing description is in all aspects illustrative and not restrictive. It is understood that numerous other modifications and variations can be devised without departing from the scope of the invention.

What is claimed is:

1. A storage medium having stored therein a music playing program to be executed in a computer of an apparatus operated in accordance with an acceleration detected by an input device including an acceleration sensor for detecting the acceleration in at least one axial direction, causing the computer to execute:

acquiring acceleration data outputted from the acceleration sensor;

calculating a magnitude of the acceleration by using the acquired acceleration data;

selecting at least one piece of track data representing a target music to play from music piece data including a plurality of pieces of track data stored in a computer readable memory, based on the calculated magnitude of the acceleration; and outputting data for controlling a sound generated from a sound generation device, based on the selected track data;

detecting a peak value of the magnitude of the acceleration by using a history of the magnitude of the calculated acceleration, wherein, in the selection of the at least one piece of track data, the track data representing the target music to play is selected based on the peak value, of the magnitude of the acceleration, detected in the detecting of the peak value of the magnitude of the acceleration.

2. The storage medium having stored therein the music playing program according to claim 1, wherein the acceleration sensor detects the acceleration in each of a plurality of axial directions perpendicular to each other with respect to the input device, and, in the calculation of the magnitude of the acceleration, a magnitude of a resultant vector for which acceleration vectors in the plurality of axial directions are respectively combined is calculated by using the acquired acceleration data.

3. The storage medium having stored therein the music playing program according to claim 1, wherein each of the plurality of pieces of track data is allocated a different musical instrument, and the computer is caused to further execute arranging the musical instrument allocated to each of the plurality of pieces of track data in a virtual game world, and displaying on a display device an action representing only the musical instrument allocated to the selected track data.

4. A storage medium having stored therein a music playing program to be executed in a computer of an apparatus operated in accordance with an acceleration detected by an input device including an acceleration sensor for detecting the acceleration in at least one axial direction, causing the computer to execute:

acquiring acceleration data outputted from the acceleration sensor;

calculating a magnitude of the acceleration by using the acquired acceleration data;

selecting at least one piece of track data representing a target music to play from music piece data including a plurality of pieces of track data stored in a computer readable memory, based on the calculated magnitude of the acceleration; and outputting data for controlling a sound generated from a sound generation device, based on the selected track data;

wherein the calculation of the magnitude of the acceleration includes calculating a difference between an acceleration calculated by using the acceleration data previously acquired and an acceleration calculated by using the acceleration data currently acquired, and, in the selection of the track data, the track data representing the target music to play is selected based on the calculated difference of the acceleration.

5. The storage medium having stored therein the music playing program according to claim 4, causing the computer to further execute detecting a peak value of the difference of the acceleration by using a history of the calculated difference of the acceleration, wherein, in the selection of the track data, the track data representing the target music to play is selected based on the detected peak value, of the difference of the acceleration.

6. The storage medium having stored therein the music playing program according to claim 4, wherein the acceleration sensor detects the acceleration in each of a plurality of axial directions perpendicular to each other with respect to the input device, and, in the calculation of the difference, the difference between the acceleration calculated by using the acceleration data previously acquired and the acceleration calculated by using the acceleration data currently acquired is calculated for each of the plurality of axial directions, and a magnitude of a difference resultant vector for which difference vectors in the plurality of axial directions are respectively combined is calculated as the difference of the acceleration.

7. A storage medium having stored therein a music playing program to be executed in a computer of an apparatus operated in accordance with an acceleration detected by an input device including an acceleration sensor for detecting the acceleration in at least one axial direction, causing the computer to execute:

acquiring acceleration data outputted from the acceleration sensor;

calculating a magnitude of the acceleration by using the acquired acceleration data;

selecting at least one piece of track data representing a target music to play from music piece data including a plurality of pieces of track data stored in a computer readable memory, based on the calculated magnitude of the acceleration; and outputting data for controlling a sound generated from a sound generation device, based on the selected track data;

wherein the music piece data includes a plurality of track data groups each having different track data, in the calculation of the magnitude of the acceleration, the magnitude of the acceleration calculated from the acceleration data currently acquired, and the difference between the acceleration calculated by using the acceleration data previously acquired and the acceleration calculated by using the acceleration data currently acquired are calculated, the music playing program causes the computer to further execute:

detecting a peak value of the magnitude of the acceleration by using a history of the calculated magnitude of the acceleration; and detecting a peak value of the difference of the acceleration by using a history of the difference of the calculated acceleration, and in the selection of the track data, a track data group representing a target music to play is selected based on the detected peak value of the difference of the acceleration, and, based on the detected peak value of the magnitude of the acceleration, the track data representing the target music to play is selected from the track data group representing the target music to play.

8. The storage medium having stored therein the music playing program according to claim 7, wherein music data allocated to the track data group and music data allocated to another track data group are different in at least one of a style of playing music, a number of beats, and a tonality.

9. A music playing apparatus operable in accordance with an acceleration detected by an input device including an acceleration sensor for detecting the acceleration in at least one axial direction, comprising:

acceleration data acquisition programmed logic circuitry for acquiring acceleration data outputted from the acceleration sensor;

acceleration calculation programmed logic circuitry for calculating a magnitude of the acceleration by using the acquired acceleration data;

track data selection programmed logic circuitry for selecting at least one piece of track data representing a target music to play from music piece data including a plurality of pieces of track data stored in a machine readable memory, based on the calculated magnitude of the acceleration, and music performance programmed logic circuitry for outputting data for controlling a sound generated from a sound generation device, based on the track data selected by the track data selection programmed logic circuitry;

an acceleration peak value detection programmed logic circuitry for detecting a peak value of the magnitude of the acceleration by using a history of the magnitude of the acceleration calculated in the acceleration calculation programmed logic circuitry, wherein the track data representing the target music to play is selected based on the peak value, of the magnitude of the acceleration, detected by the acceleration peak value detection programmed logic circuitry.

* * * * *